US007507134B2

(12) United States Patent
Iba et al.

(10) Patent No.: US 7,507,134 B2
(45) Date of Patent: Mar. 24, 2009

(54) METHOD FOR PRODUCING ELECTRON BEAM APPARATUS

(75) Inventors: Jun Iba, Kanagawa-ken (JP); Hisanobu Azuma, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 667 days.

(21) Appl. No.: 11/229,633

(22) Filed: Sep. 20, 2005

(65) Prior Publication Data

US 2006/0063459 A1 Mar. 23, 2006

(30) Foreign Application Priority Data

Sep. 22, 2004 (JP) ..... 2004-274578

(51) Int. Cl.
*H01J 9/50* (2006.01)
*H01J 9/42* (2006.01)

(52) U.S. Cl. ..... 445/5; 445/3; 445/6; 445/59

(58) Field of Classification Search ..... 445/3, 445/5, 6, 24, 25, 59
See application file for complete search history.

(56) References Cited

U.S. PATENT DOCUMENTS

| | | | | |
|---|---|---|---|---|
| 6,703,791 | B2 | 3/2004 | Azuma | 315/169.3 |
| 6,972,203 | B2 | 12/2005 | Azuma | 438/20 |
| 2005/0266761 | A1 | 12/2005 | Azuma | 445/5 |
| 2006/0087219 | A1 | 4/2006 | Taniguchi et al. | 313/495 |
| 2006/0087220 | A1 | 4/2006 | Hiroki et al. | 313/495 |
| 2006/0164001 | A1 | 7/2006 | Iba et al. | 313/495 |

FOREIGN PATENT DOCUMENTS

| | | | |
|---|---|---|---|
| JP | 09274875 A | * | 10/1997 |
| JP | 2000-243287 | | 9/2000 |
| JP | 2003045334 A | * | 2/2003 |
| KR | 2003-0025148 | | 3/2003 |
| WO | WO 00/44022 | | 7/2000 |

OTHER PUBLICATIONS

Utsumi, T., "Cathode- and Anode-Induced Electrical Breakdown in Vacuum*", *Journal of Applied Physics*, vol. 38, No. 7, pp. 2989-2997 (Jun. 1967).

* cited by examiner

*Primary Examiner*—Mariceli Santiago
(74) *Attorney, Agent, or Firm*—Fitzpatrick, Cella, Harper & Scinto

(57) ABSTRACT

In a producing method for an electron beam emitting device, a position of a stray emission source constituting an unnecessary electron emitting part on a cathode substrate is detected, and an energy is locally applied to the detected position thereby eliminating the stray emission source, thereby providing an excellent electron beam apparatus without a deterioration in a constituent member or a trouble by an accidental discharge.

14 Claims, 18 Drawing Sheets

METHOD FOR PRODUCING ELECTRON BEAM APPARATUS

BACKGROUND OF THE INVENTION

1. Field of the Invention

The present invention relates to a method for producing an electron beam apparatus and an electron beam apparatus, in which a cathode substrate provided with plural electron-emitting devices and an anode substrate for receiving electron beams from the electron-emitting devices of the cathode substrate are mutually opposed across a reduced-pressure space (vacuum environment).

2. Related Background Art

Recently, developments are being made for an application of an electron-emitting device such as a surface conduction electron-emitting device, a field emission electron-emitting device (FE electron-emitting device), or a metal/insulator/metal electron-emitting device (MIM electron-emitting device) to an electron beam apparatus for example a display panel, an image display apparatus utilizing the same, an image forming apparatus such as an image recording apparatus, or a charged beam source.

An electron beam apparatus is constituted of a cathode substrate provided with plural electron-emitting devices and an anode substrate for receiving electron beams from the electron-emitting devices of the cathode substrate are mutually opposed across a reduced-pressure space, and a high voltage of several hundred volts or more (high electric field of 1 kV/mm or higher) is applied between the cathode substrate and the anode substrate, in order to accelerate the electrons from the electron-emitting device. In such environment, if an extraneous substance is present in the vacuum container, such extraneous substance also becomes an unnecessary emission part (electron-emitting portion) other than the proper electron-emitting devices for image display and causes an electron emission.

In case the electron beam apparatus is for example a display panel of an image display apparatus, such unnecessary emission part constitutes a continuously light emitting source of DC type by the application of the high voltage, thus generates a very bright point even with a very slight current (for example 1 nA or less), and becomes a very annoying obstacle. Such unnecessary emission part is assumed to be caused by formation of a projection, an MIM structure or an MIV (metal/insulator/vacuum) structure by the contamination with the extraneous substance. The electron emission or light emission caused by such unnecessary emission part is generally called an electron group unnecessary for imaging, a floating electron group, a stray electron emission or an abnormal light emission, but will be called stray emission (also abbreviated as SE) in the present specification.

In the producing process for an electron beam apparatus, particularly an image forming apparatus utilizing surface conduction electron-emitting devices, it is proposed to oppose an electrode of an anode substrate to a wiring of a cathode substrate, and to apply a certain high voltage between the wiring and the electrode (such operation generally called a conditioning) to generate a discharge phenomenon, thereby eliminating an unnecessary emission part (SE source) (for example cf. WO00/044022).

However, such prior method, requiring a conditioning on the entire apparatus, is associated with a drawback of causing an accidental discharge in a portion not showing SE, thereby causing a deterioration of the components. Also the conditioning operation, because of an excessively high voltage applied to the entire panel, causes an increased danger for a discharge and, though intended for eliminating the SE source, results in a damage by an accidental discharge, thereby leading to a deterioration in the image. Also, for example in an image display apparatus, a discharge threshold voltage of the SE source is often far higher (2 to 10 times) than the voltage applied at the image display, and it is difficult to apply such high voltage over the entire panel.

SUMMARY OF THE INVENTION

An object of the present invention is to provide an electron beam apparatus allowing to selectively eliminate an SE source without inducing a deterioration of constituent members by an accidental discharge, and not associated with a deterioration of constituent members resulting from the elimination of the SE source not with a trouble by SE.

More specifically, the present invention is to provide a method for producing an electron beam apparatus including an SE detection step of detecting a position of a stray emission (SE) source on a cathode substrate, and an SE eliminating step of locally applying an energy for eliminating SE in the position of the SE source detected by the SE detection step.

DETAILED DESCRIPTION OF THE PREFERRED EMBODIMENTS

Figure 1:
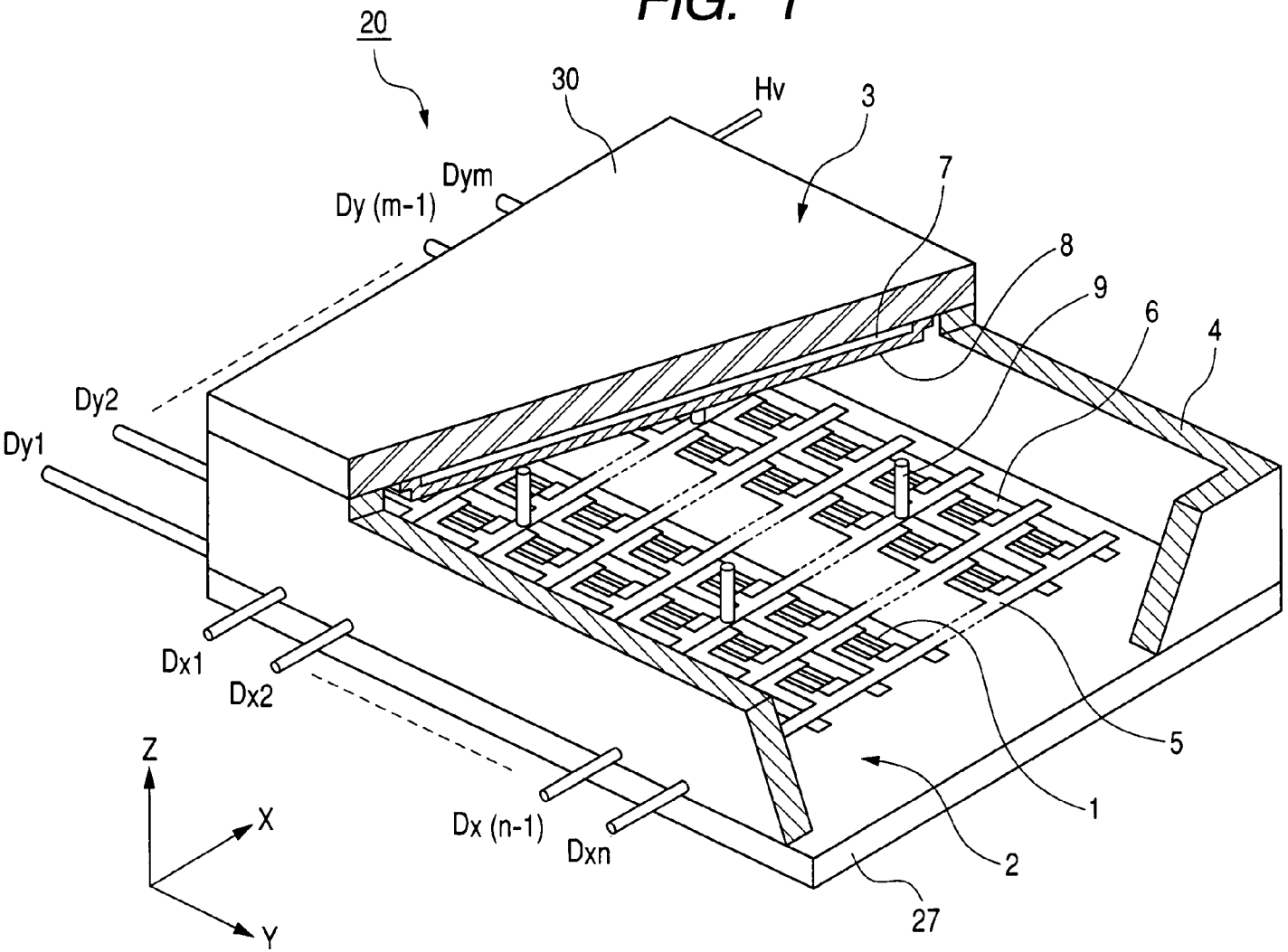
FIG. 1 is a partially cut-off schematic perspective view of a display panel constituting an example of an electron beam apparatus.

The present invention provides a method for producing an electron beam apparatus including an SE detection step of detecting a position of a SE source on a cathode substrate, and an SE eliminating step of locally applying an energy for eliminating SE in the position of the SE source detected by the SE detection step.

The SE detection step in the present invention has following three embodiments.

A first embodiment of the SE detection step is to execute an operation of applying a voltage to an anode electrode placed in an opposed relation to a cathode substrate and measuring a signal generated by an SE in a scanning motion of the anode electrode thereby obtaining a peak position of the signal, under a change in a distance between the cathode substrate and the anode electrode, and to derive a peak position, corresponding to a zero distance, based on a relation between each distance and a corresponding peak position, thereby detecting the position of the SE source.

A second embodiment of the SE detection step is to execute an operation of applying a voltage to an anode electrode placed in an opposed relation to a cathode substrate and measuring a signal generated by an SE in a scanning motion of the anode electrode thereby obtaining a peak position of the signal, under a change in the applied voltage, and to derive a peak position, corresponding to an infinite applied voltage, based on a relation between each applied voltage and a corresponding peak position, thereby detecting the position of the SE source.

A third embodiment of the SE detection step is, after combining a cathode substrate and an anode substrate, to execute an operation of applying a voltage to the anode electrode with a photo detector positioned in an opposed relation thereto, and measuring a light intensity generated by an SE with an operation of the photo detector, under a change in a voltage applied to the anode substrate, and to derive a peak position, corresponding to an infinite voltage, based on a relation between each voltage and a corresponding peak position, thereby detecting the position of the SE source.

Also the present invention provides an electron beam apparatus produced by any of the aforementioned producing methods for the electron beam apparatus.

According to the present invention, as the SE elimination process can be executed only to an SE generating position, it is possible to eliminate SE while preventing unnecessary accidental discharge, thereby providing an excellent electron beam apparatus without a deterioration of members by an accidental discharge, or a trouble by SE.

Also according to the present invention, it is possible, by reducing an anode electrode (or a capacitance thereof) or a voltage applied at the discharge, to suppress a charge amount at the discharge, thereby limiting the discharge to the position of SE generation and providing excellent discharge characteristics without a damage by discharge.

Also according to the present invention, the SE elimination step may be executed after the preparation of a display panel thereby capable of eliminating an SE even if it is generated after a sealing of the display panel.

In the following, a producing method of the present invention for an electron beam apparatus will be explained in a display panel and an image display apparatus utilizing the same.

FIG. 1 is a partially cut-off schematic perspective view showing a display panel for an image display apparatus which is a representative example of the electron beam apparatus.

As shown in FIG. 1, a display panel 20 of the present example is formed by a rear plate 2 which is a cathode substrate provided with plural electron-emitting devices and a face plate 3 which is an anode substrate for receiving electron beams from the electron-emitting devices of the rear plate 2, both plates being opposed with a gap therebetween and surrounded and sealed by a frame member 4 to constitute a panel with an interior of a reduced pressure.

The electron-emitting devices provided on the rear plate 2 are connected in a matrix by X-direction wirings (upper wirings) 5 and Y-direction wirings (lower wirings) 6 and are matrix driven by lead terminals Dx1 to Dxn connected to the X-direction wirings 5 and lead terminals Dy1 to Dym connected to the Y-direction wirings 6. Also the face plate 3 is provided, on an internal surface thereof, with a phosphor 7 for emitting light in response to the electron beam irradiation from the electron-emitting devices 1 thereby displaying an image, and a metal back 8 constituting an electrode for accelerating electrons from the electron-emitting devices 1. A high voltage terminal Hv is provided for supplying the metal back 8 with a high voltage.

Between the rear plate 2 and the face plate 1, there is sandwiched a spacer 9 for increasing a resistance to the atmospheric pressure.

A base plate 27 is provided as a base of the rear plate 2, and a base plate 30 is provided as a base of the face plate 3.

Figure 2:
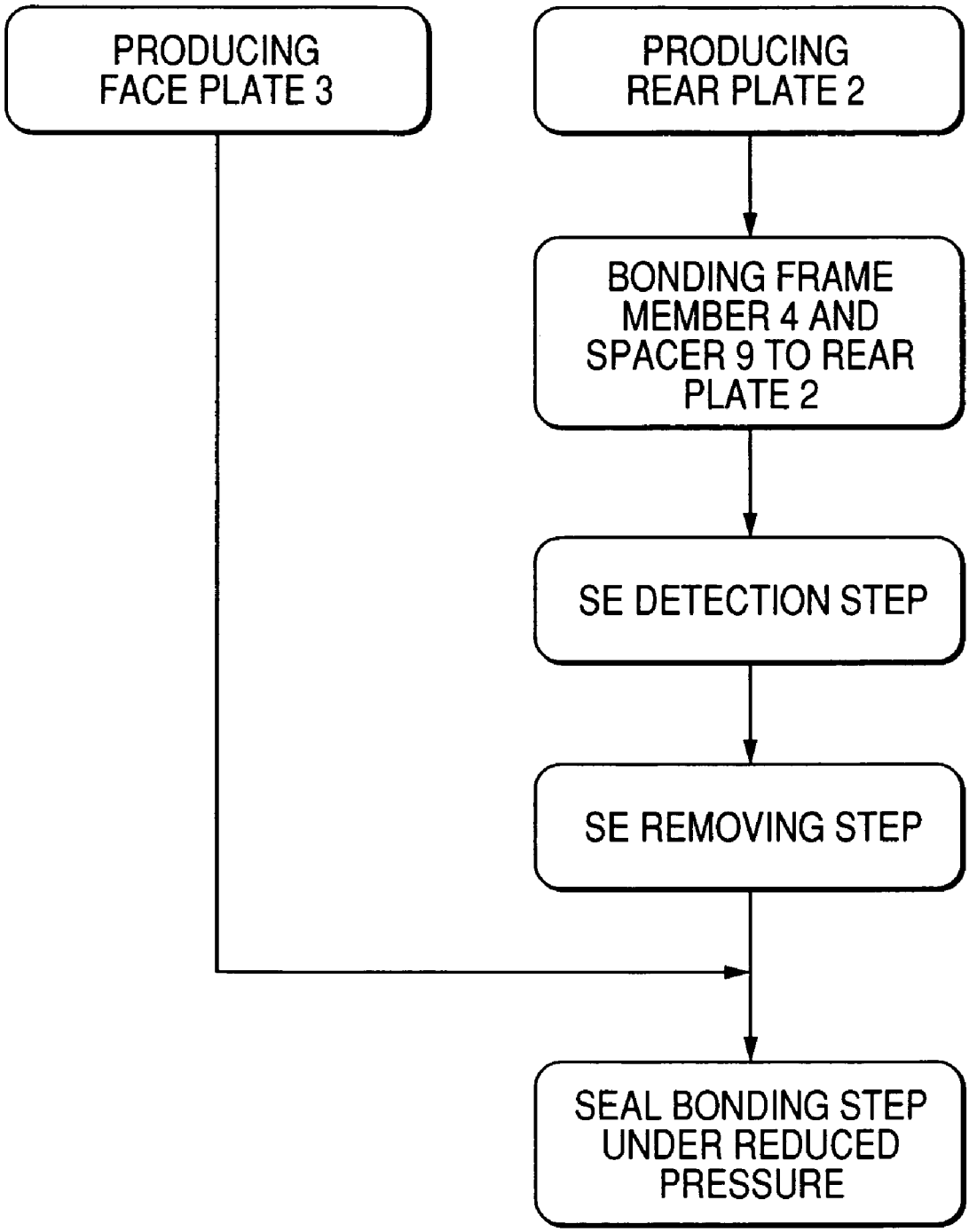
FIG. 2 is a flow chart of a production process for producing a display panel shown in FIG. 1, by a producing method of the present invention.

FIG. 2 shows a first example of the producing process in case of producing the display panel shown in FIG. 1, by the producing method of the present invention.

In the first example shown in FIG. 2, after a frame member 4 and a spacer 9 are adhered to a prepared rear plate 2, an SE detection step and an SE source elimination step are executed before a separately prepared face plate 3 is adhered and sealed.

Further referring to FIGS. 1 and 2, the electron-emitting devices 1, the X-direction wirings, the Y-direction wirings and the lead terminals Dx1 to Dxn, Dy1 to Dym are formed on a base plate constituting the rear plate 2, the separately prepared frame member 4 and the spacer 9 are adhered thereto.

Then the rear plate 2, on which the frame member 4 and the spacer 9 are adhered, is subjected to an SE detection step and an SE source elimination step.

Separately from the rear plate 2, there is prepared a face plate 3 provided with a phosphor 7, a metal back and a high voltage terminal Hv, and such face plate 3 and the rear plate 2 are brought into a chamber evacuated to a reduced pressure, and are adhered in a mutually opposed relationship and sealed as a panel-shaped envelope thereby obtaining a display panel 20 shown in FIG. 1.

Figure 3:
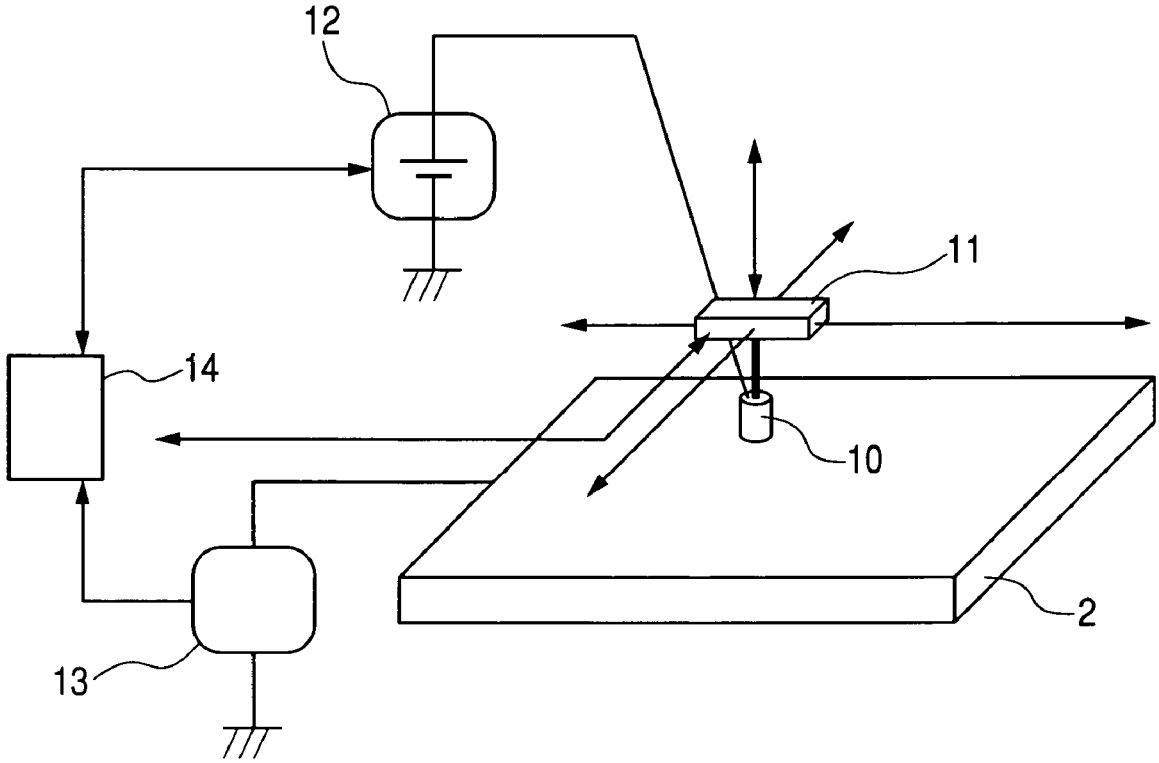
FIG. 3 is a schematic perspective view showing a first example of an apparatus usable for SE detection and elimination of SE source.

In the following, there will be explained an SE detection step shown in FIG. 2, based on FIG. 3 showing an example of a detection apparatus to be employed in the SE detection step.

In FIG. 3, there are shown an anode electrode 10, a moving apparatus 11, a high voltage source 12, an ammeter 13, a control apparatus 14 and a rear plate 2 shown in FIG. 1, from which the electron-emitting devices 1, the X-direction wirings 5, the Y-direction wirings 5, the lead terminals Dx1 to Dxn, Dy1 to Dym, the frame member 4 and the spacer 9 are omitted.

The anode electrode 10 is given a high voltage by the high voltage source 12, and is rendered variable, by the moving apparatus 11, in an opposed position (position in X and Y directions in FIG. 1) to the internal face of the rear plate 2 and in a distance between the rear plate 2 and the anode electrode 10 (position in Z direction in FIG. 1). The ammeter 13 is used for measuring an emission current flowing by an SE through the rear plate 2, and is connected in common to conductive members on the rear plate 2. The control apparatus 14 reads a current value from the ammeter 13 and controls a position of the anode electrode by the moving apparatus 11 and a voltage of the high voltage source 12.

At first the moving apparatus 11 sets the distance D between the rear plate 2 and the anode electrode 10 at a predetermined distance D1, and the high voltage source 12 applies V1 as a voltage V applied to the anode electrode 10. In this state, an electric field intensity E1=V1/D1 is selected equal to or less than a value applied at the image display.

Then the moving apparatus 11 executes a scanning motion in the rear plate 2 while maintaining the distance D1, and there are measured, in each position within the plane, X, Y coordinate values of the anode electrode 10 and a current value indicated by the ammeter 13. The scanning operation is so conducted that the anode electrode 10 does not touch the spacer 9 (cf. FIG. 1) adhered to the rear plate 2.

Then the moving apparatus 11 changes the distance between the rear plate 2 and the anode electrode 10 from D1 to D2 (D1>D2), and the voltage applied by the high voltage source 12 is changed to V2 so as to maintain a constant electric field strength (V2=V1×D2/D1). Then the rear plate 2 is again scanned and the current and the X, Y coordinate values of the anode electrode 10 are measured at each position in the plane. Similar scanning operations are conducted for D3 and D4 (D2>D3, D3>D4).

Figure 4:
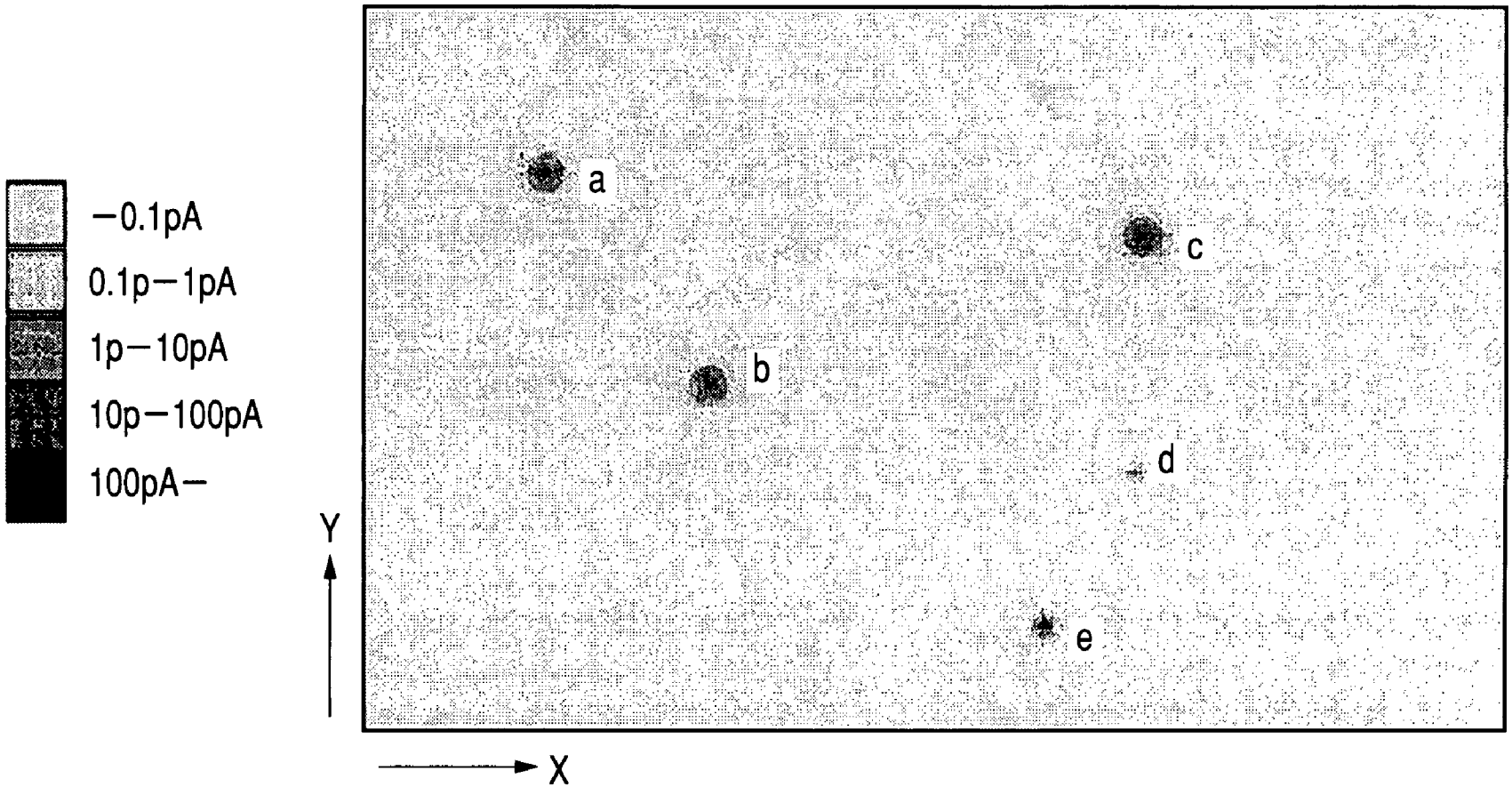
FIG. 4 is a schematic view (contour line map) of a current distribution within a plane of a rear plate, measured by the apparatus shown in FIG. 3.

FIG. 4 is a schematic view showing a current distribution (contour line map) within the rear place 2 at the distance D1.

In this example, a local current increase (SE current distribution) occurs in 5 locations a to e, which are generated by SE. Similar current distributions are determined for the distances D2 to D4, though not illustrated.

Figure 5:
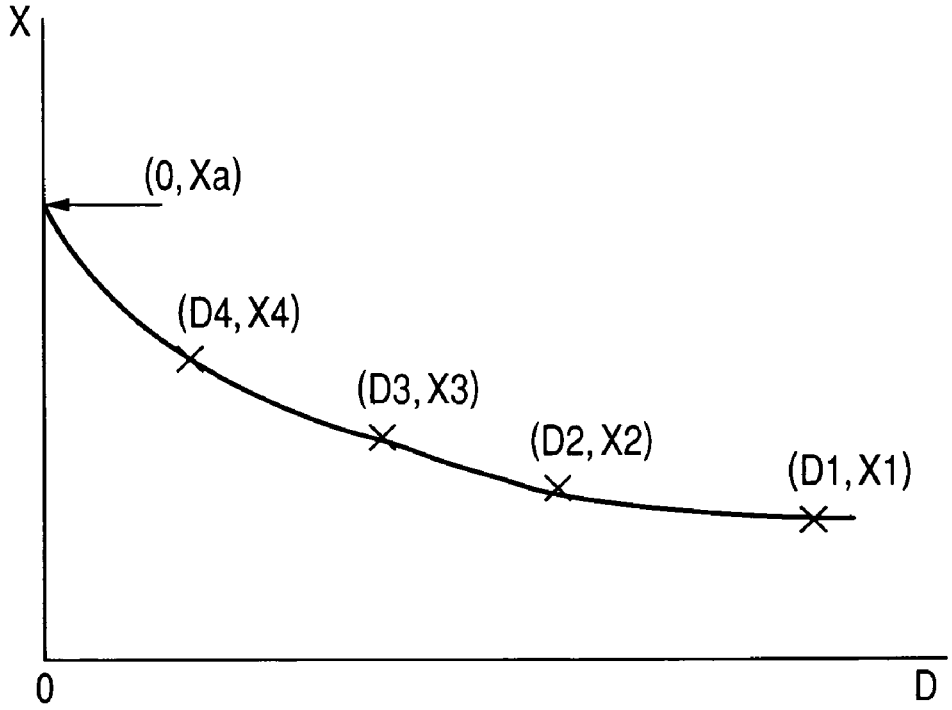
FIG. 5 is a chart showing a relationship between an X-coordinate of an SE maximum current point and a distance between an anode electrode and a rear plate.

Then, taking peaks of the current at the current distribution points a to e as SE maximum current points, the X and Y coordinates of the anode electrode 10 in the rear plate 2 are determined when an SE maximum current point is detected, and a plotting is prepared as shown in FIG. 5, taking the distance D on the abscissa and the X coordinate (or Y coordinate) on the ordinate. FIG. 5 shows a plotting, of the SE maximum current points of the SE current distribution point a in FIG. 4, of X-coordinate X1 at distance D1, X-coordinate X2 at distance D2, X-coordinate X3 at distance D3, and X-coordinate X4 at distance D4.

X-coordinate of the SE maximum current point becomes different at the distances D1 to D4 as shown in FIG. 5, because, in an electron beam apparatus such as the image display apparatus as shown in FIG. 1, the rear plate 2 usually has convex and concave portions mainly because of wirings, and the trajectory of electrons are bent by an electric field resulting therefrom.

Figure 6:
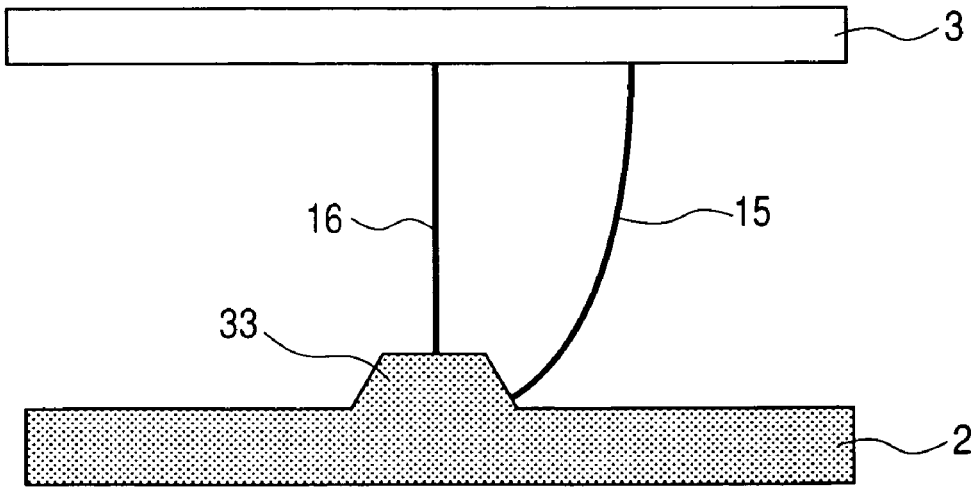
FIG. 6 is a view showing a relation between a convex-concave shape of the rear plate and an electron trajectory.

FIG. 6 shows a relationship among an electronic trajectory, a rear plate 2 having an SE source, and a face plate 3.

Figure 15A:
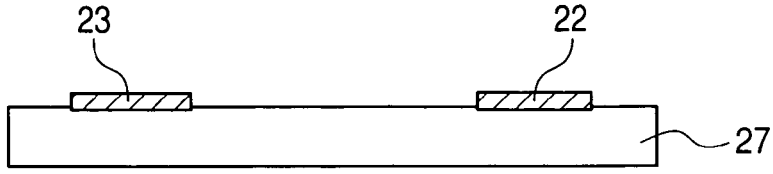
FIGS. 15A, 15B, 15C and 15D are schematic views showing a production steps of the surface conduction electron-emitting device prepared in an example 1.
Figure 15B:
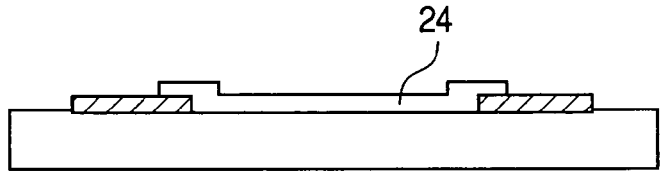
Figure 15C:
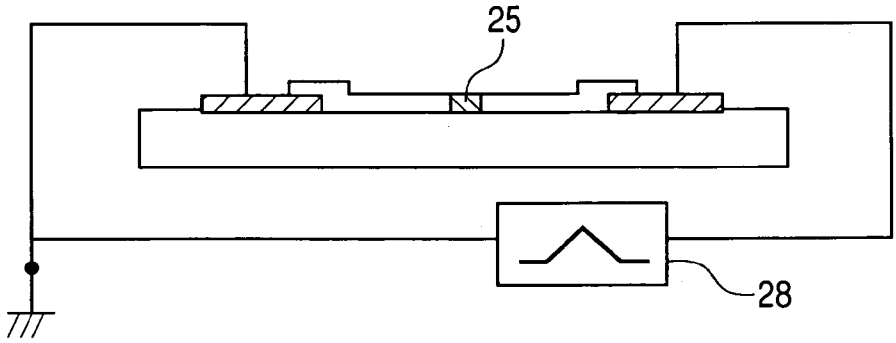
Figure 15D:
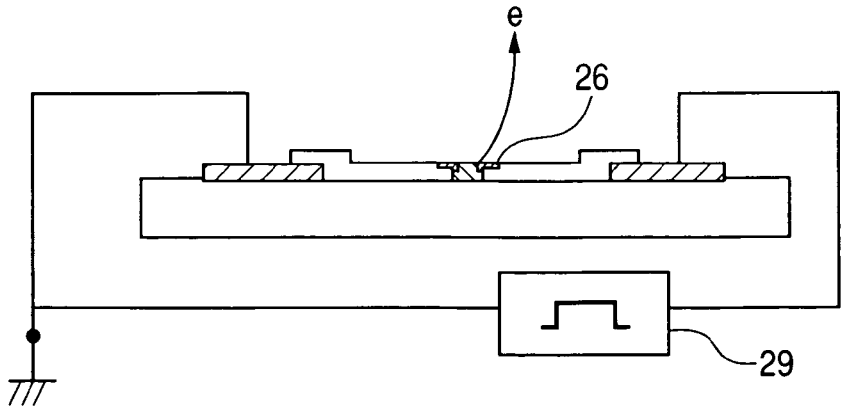
Figure 16:
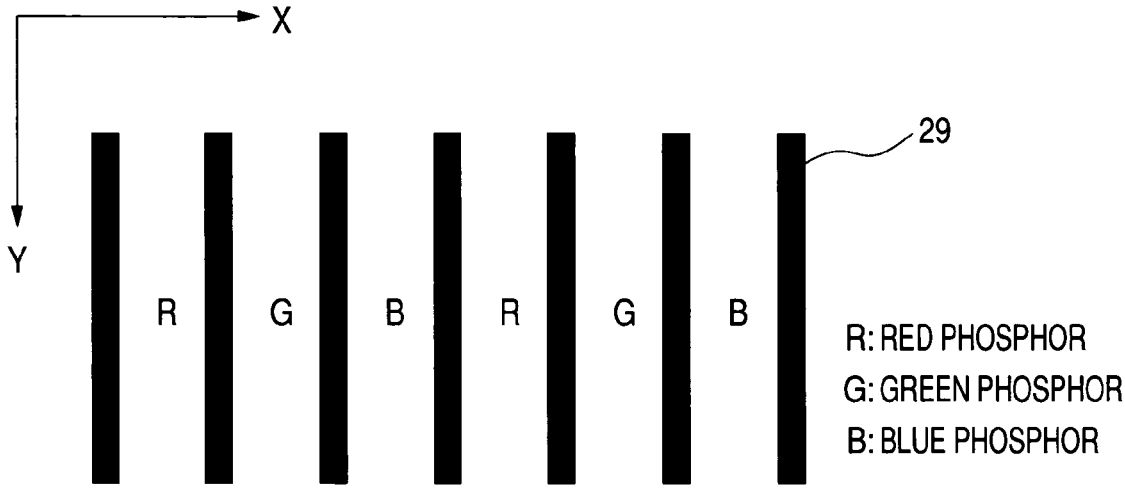
FIG. 16 is a plan view showing an example of arrangement of phosphors on a face plate prepared in an example 1.

In FIGS. 6, 15 and 16 show trajectories of electron emissions generated from an SE source (not shown) formed on the rear plate 2, toward the face plate 3 receiving a predetermined voltage. As shown in FIG. 6, a deflection amount is smaller (trajectory 16) when the SE source is positioned on top of a convex portion 33 on the rear plate, while a deflection amount becomes larger (trajectory 15) when the SE source is positioned at a side of the convex portion 33. Also in case the SE source is a projection, the trajectory of the electrons is deflected in a direction of inclination thereof.

As explained above, the SE trajectory in the electron beam apparatus may be deviated, but a position Xa in the X-direction at a distance D=0 can be determined by extrapolating the plotting of the SE maximum current points as shown in FIG. 5. Such coordinate Xa is the X-coordinate of the SE source on the rear plate 2, constituting the cause of the SE current distribution point a. Also by determining the position in Y-direction at D=0 in a similar manner, there can be determined the Y-coordinate of the SE source, constituting the cause of the SE current distribution point a.

In this manner, the position of the SE source in the plane of the rear plate 2 can be derived exactly. In particular, a more exact derivation of position is possible by minimizing the distance D and increasing the number of measuring points.

Figure 7:
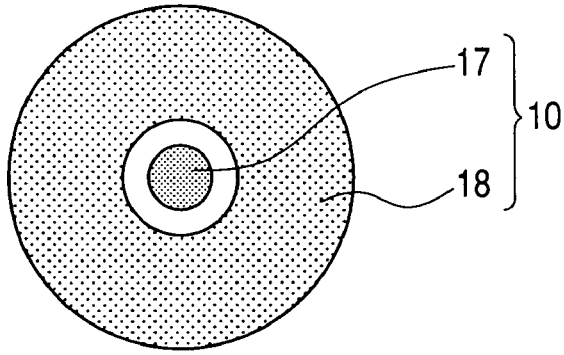
FIG. 7 is a cross-sectional view showing another example of the anode electrode.
Figure 8:
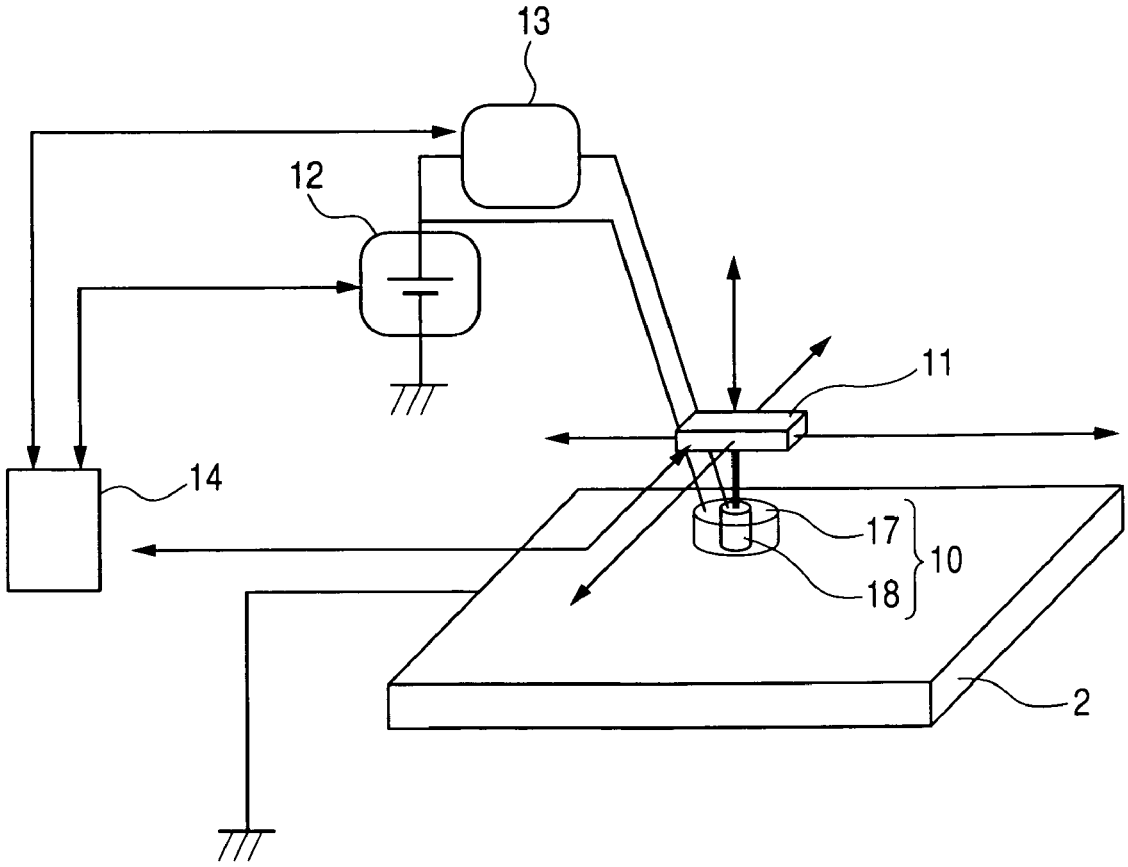
FIG. 8 is a schematic perspective view showing an example of an apparatus having an anode electrode shown in FIG. 7, usable for SE detection and elimination of SE source.

The anode electrode 10 may be divided, as shown in FIG. 7, into a signal detecting portion 17 for applying a voltage and detecting a signal, and an auxiliary electrode 18 for applying a voltage. In such case, the ammeter 13 is connected, as shown in FIG. 8, between the high voltage source 12 and the signal detecting portion 17. The auxiliary electrode 18 has a function of applying a voltage, and forms the electric field around the signal detecting portion 17 into a parallel field, thereby facilitating the detection. An area of a face of the auxiliary electrode 18, opposed to the rear plate 2, is preferably 3 to 5 times of that of the signal detecting portion 17. The signal detecting portion 17 may be so constructed as not to apply a voltage.

In the foregoing description, a current is employed as the detection signal in the SE detection step, but a light intensity measured with a photodetector may also be employed. It is also possible to construct the signal detector for detecting a current or a light intensity into multi channels thereby measuring a current distribution or a light intensity distribution over a large area. There can also be adopted a method of simultaneously measuring a current and a light intensity.

In case of measuring the light intensity, the anode electrode 10 and the signal detecting portion 17 may be constructed, in addition to the configuration shown in FIG. 7, in such a manner that the signal detecting portion 17 is provided behind the anode electrode having a transparent electrode such as of ITO, thereby detecting the light intensity through the anode electrode 10.

In the foregoing description, there has been explained a configuration in which the spacer 9 and the frame member 4 are mounted on the rear plate 2, but they may also be mounted on the face plate 3. In such configuration, the scanning operation with the anode electrode 10 on the rear plate can be facilitated as it no longer needs to detour the spacer 9.

In the following there will be explained an SE elimination step shown in FIG. 2.

The SE elimination step can be executed by the aforementioned apparatus shown in FIG. 3.

At first the anode electrode 10 is moved by the moving apparatus to the position of the SE source specified by the SE detection step, and is set at a predetermined distance Dr.

Then a predetermined voltage Vr is applied by the high voltage source 12. The applied voltage Vr preferably has such a polarity that the SE source side becomes positive side. An electric field strength Er=Vr/Dr, determined by the predetermined Vr and Dr, is selected higher than the electric field strength E1 in the SE detection step and at a value sufficient for eliminating SE. A voltage applying method includes a method of applying a constant voltage over a prolonged period thereby suppressing the emission, and a method of gradually increasing the voltage thereby inducing a discharge. It is also conceivable to provide thermal energy with a heater or a laser irradiation thereby increasing the eliminating effect. In any method, the SE elimination is judged by monitoring the current with the ammeter 13. It is also conceivable to destruct the SE source itself by a thermal energy only.

An SE elimination process by providing a predetermined energy only to the location of the SE source as described above allows to avoid an unnecessary accidental discharge.

In the following there will be explained another embodiment of the invention.

Figure 9:
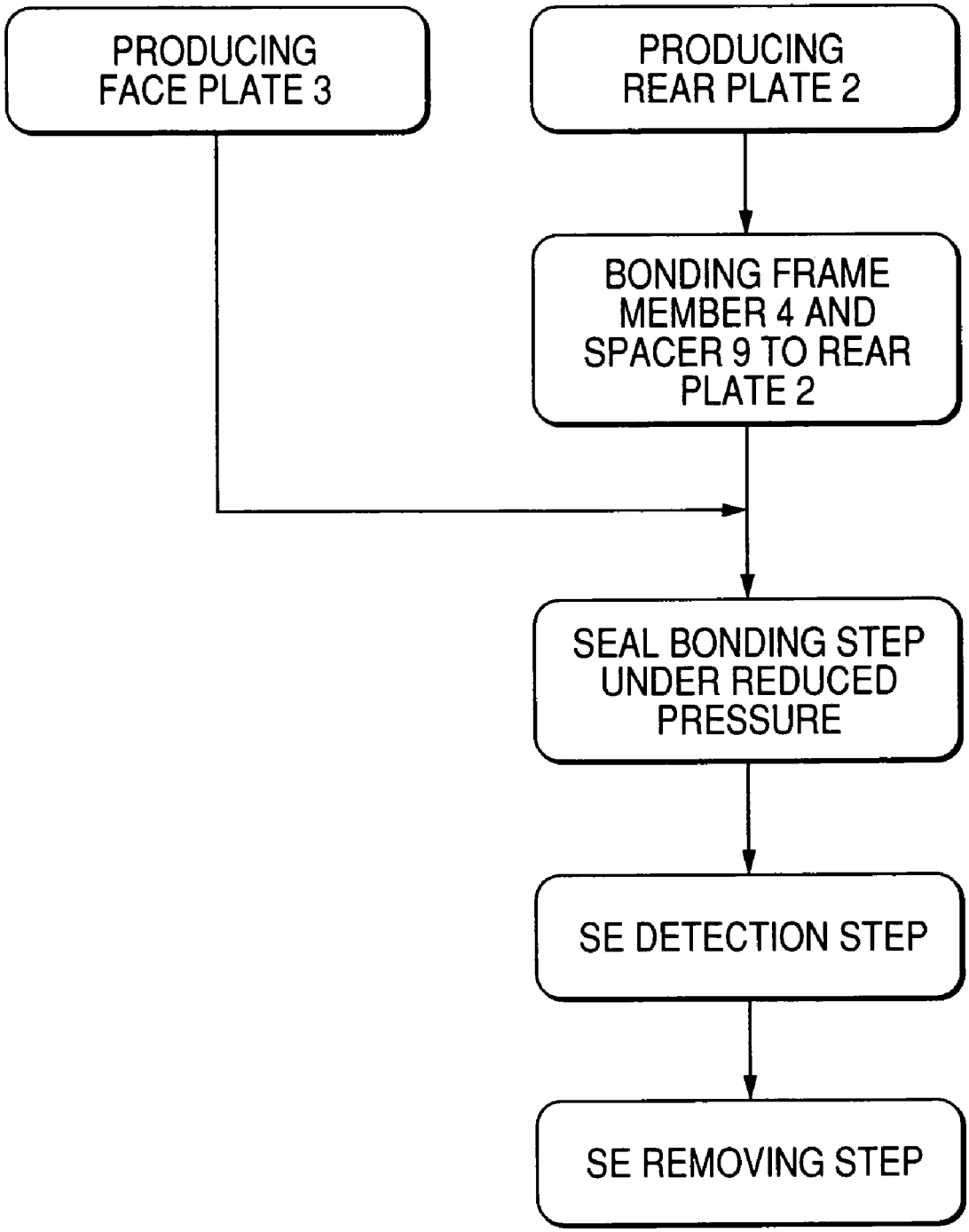
FIG. 9 is a flow chart of a production process for producing a display panel shown in FIG. 1, by a producing method of the present invention.

FIG. 9 shows a second example of the producing process in case of producing the display panel shown in FIG. 1, by the producing method of the present invention. The process shown in FIG. 9 is different from the first example, in that an SE detection step and an SE source elimination step are executed after the face plate 3 and the rear plate 2, shown in FIG. 1 are mutually adhered.

In the example shown in FIG. 9, after the preparation of the rear plate 2 including the electron-emitting devices 1, the X-direction wirings 5, the Y-direction wirings 6 and the lead terminals Dx1 to Dxn, Dy1 to Dym, the frame member 4 and the spacer 9 are adhered on predetermined positions of the rear plate 2. Then the separately prepared face plate 3 is adhered with the rear plate in a reduced-pressure atmosphere to obtain a sealed envelope. It is then subjected to an SE detection process and an SE source elimination process, to be explained in the following, thereby obtaining a display panel 20.

In the following, there will be explained an SE detection step shown in FIG. 9.

Figure 10:
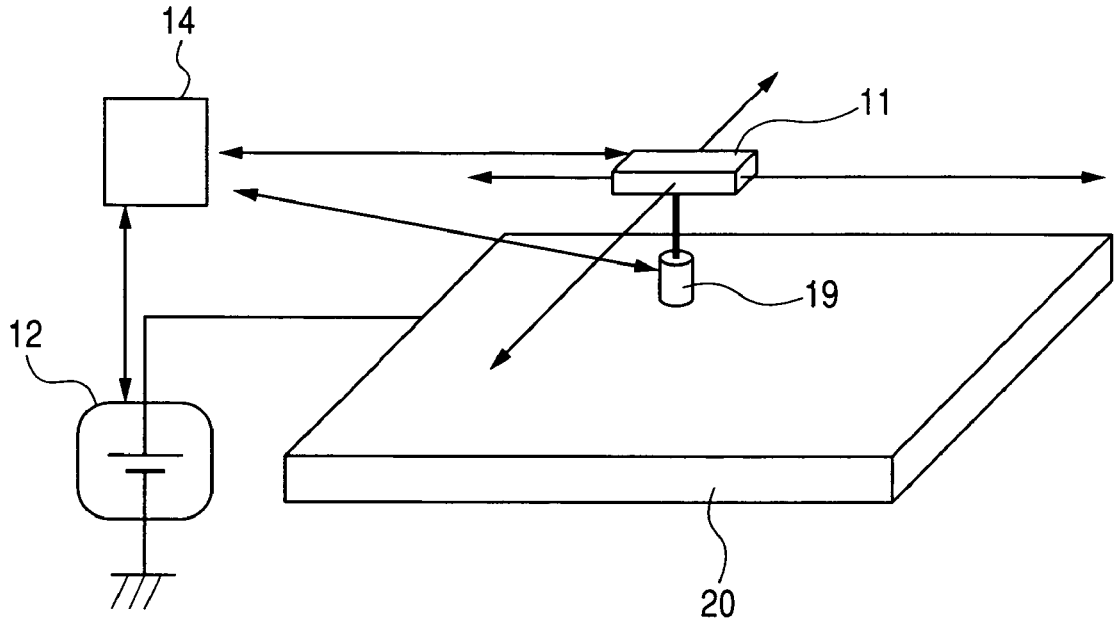
FIG. 10 is a schematic perspective view showing a second example of an apparatus usable for SE detection and elimination of SE source.

FIG. 10 is a schematic view showing another example of the detection apparatus to be employed in the SE detection step, wherein shown are a photo detector 19, a moving apparatus 11, a high voltage source 12, a display panel 20 and a control apparatus 14. In the following description, reference is made to FIGS. 10 and 1.

The display panel 20 is so positioned that the face plate 3 is opposed to the photo detector 19, which is provided for detecting a light intensity of SE. The photo detector 19 may be a single photosensor, or may be formed in multi channels for detecting a light intensity distribution. The moving apparatus 11 serves to change the position of the photo detector. The control apparatus 14 is provided for controlling the position of the photo detector 19 by the moving apparatus 11 and a voltage V applied from the high voltage source 12.

In case an SE is present, an application of the predetermined voltage V11 from the high voltage terminal Hv of the face plate 3 generates a light emission point by SE. The photo detector 19 is moved by the moving apparatus 11 within the plane of the rear plate 2 to measure a light intensity distribution, and there are obtained X, Y coordinates of an SE maximum light emission point where the light intensity reaches a maximum peak in a portion in which the light intensity shows a local increase (SE light intensity distribution).

Then the X, Y coordinates of the SE maximum light emission point are obtained in a similar manner by setting the voltage V from the high voltage source 12 at V12 to V14.

Figure 11:
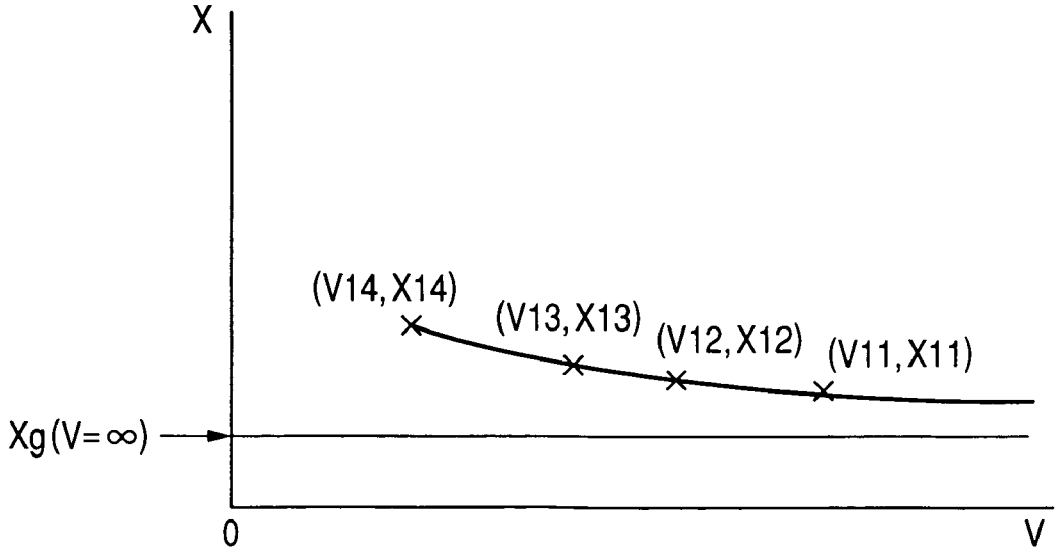
FIG. 11 is a chart showing another relationship between an X-coordinate of an SE maximum current point and a distance between an anode electrode and a rear plate.

Through these steps, there is obtained a relationship between the voltage V and the coordinate position (in X-direction) as shown in FIG. 11. An extrapolation of these plottings determines a position Xg corresponding to an infinite voltage V, and such coordinate value indicates the position of the SE source in the X-direction on the rear plate 2. Similarly the position of the SE source can be determined in the Y-direction, whereby the position of the SE source on the rear plate can derived. The plotting may also be conducted with the value of electric field instead of voltage.

The trajectory of SE electrons shows a smaller amount of deviation at a higher voltage (larger electric field strength), because of a reduced influence of convex and concave portions on the rear plate 2. This embodiment utilizes this phenomenon and derives the position of the SE source after the sealing operation.

In the aforementioned SE detection step to be applied to the rear plate 2 before the sealing, the position of the SE source can also be determined by maintaining a constant distance between the rear plate 2 and the anode electrode 10 while changing the voltage V applied to the anode electrode 10 to V11 to V14 and determining X, Y coordinates of the anode electrode 10 within the rear plate 2 at the detection of the SE maximum current point where the current reaches a maximum peak in the current distribution, thereby determining a position corresponding to an infinite voltage V.

In the following there will be explained an SE elimination step shown in FIG. 9.

Figure 12:
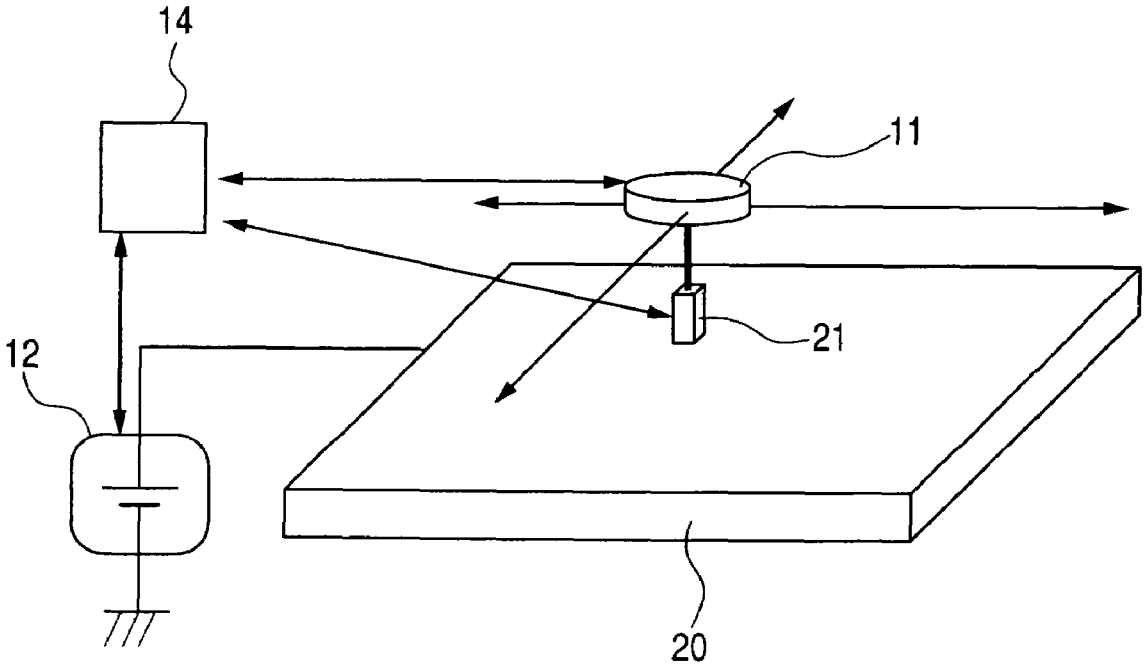
FIG. 12 is a schematic perspective view showing a third example of an apparatus usable for SE detection and elimination of SE source.

FIG. 12 shows an example of the apparatus to be employed in the SE elimination step.

In FIG. 12, there are shown a laser oscillator 21, a moving apparatus 11, a high voltage source 12, a display panel 20 and a control apparatus 14. In the following description, reference is made to FIGS. 12 and 1.

The display panel 20 is so positioned that the rear plate 2 is opposed to the laser oscillator 21, which is provided for locally heating the display panel 20. The moving apparatus 11 serves to change the position of the laser oscillator 21. The control apparatus 14 is provided for controlling the laser oscillator 21, the moving apparatus 14 and the high voltage source 12.

At first the laser oscillator 21 is moved by the moving apparatus 14 to the position of the SE source specified by the SE detection step. Then a predetermined voltage Vr is applied by the high voltage source 12. Thereafter, a local heating is executed by the laser oscillator 21. The heating elevates the temperature of cathode side constituting the SE source, thereby achieving a discharge elimination with a low discharge threshold (electric field) while suppressing a damage. (For this principle, see T. Utsumi, J. Appl. Phys., Vol. 38, No. 7, p. 2989(1967))

As explained above, the SE elimination step may be executed even after the sealing operation by applying a predetermined energy only to the position of the SE source, and can eliminate the SE while avoiding an unnecessary discharge in positions other the SE source.

EXAMPLES

In the following, the present invention will be further clarified by examples.

Example 1

This example is to execute an SE detection before sealing, and to execute an SE elimination by a local conditioning.

(Outline of Display Panel)

A display panel 20 of the image display apparatus to be produced is as already explained in FIG. 1, and maintains a vacuum of about $10^{-5}$ Pa therein.

(Preparation of Rear Plate)

Figure 13:
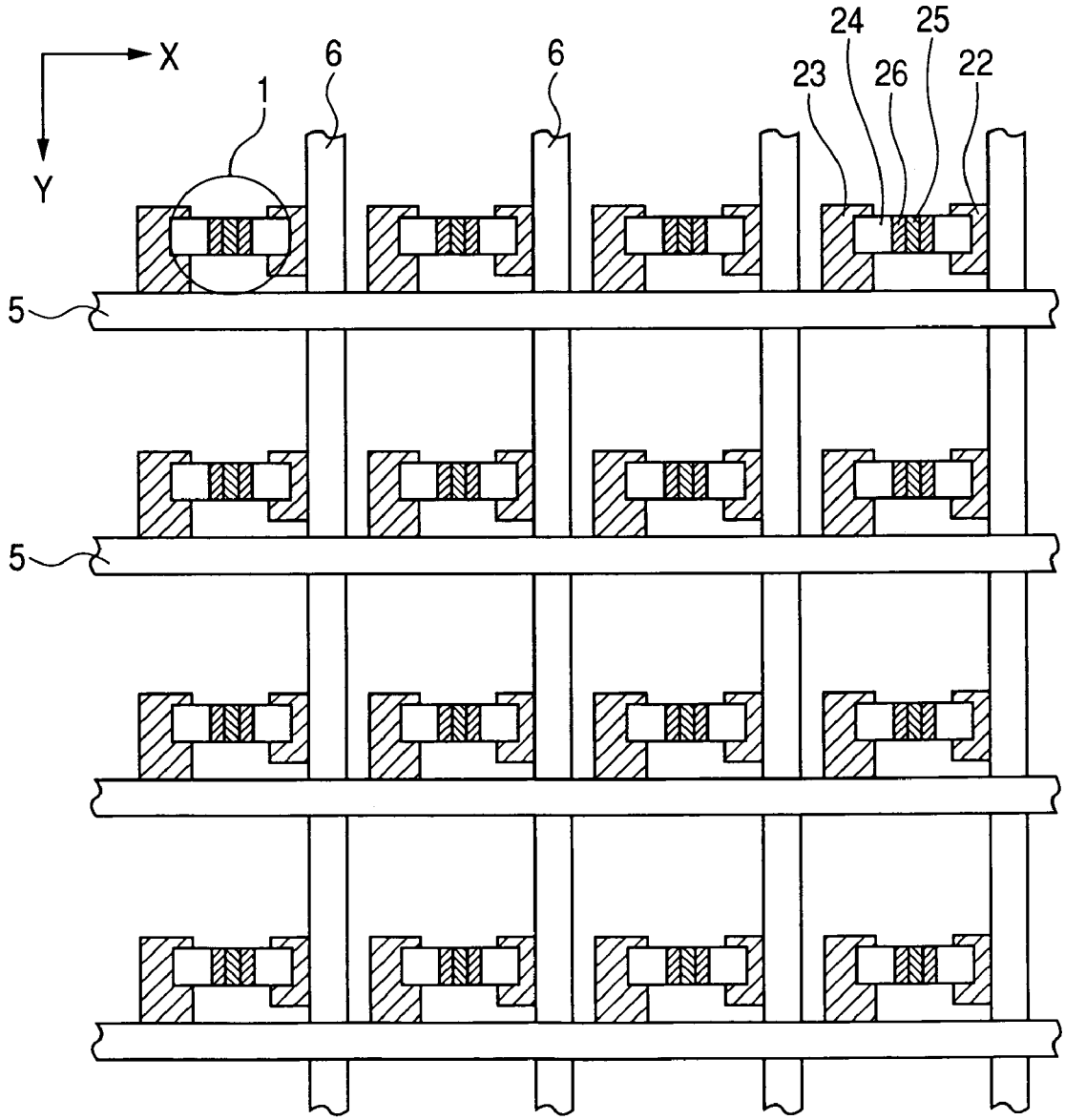
FIG. 13 is a plan view of a multi electron beam source employed in an example 1 of the present invention.

As shown in FIG. 1, the rear plate 2 is provided with plural electron-emitting devices 1. Such electron-emitting devices 1 are cold cathode devices, and are representatively arranged in a simple matrix arrangement in which, as shown in FIG. 13, a pair of device electrodes 22, 23 are respectively connected to the X-direction wiring 5 and the Y-direction wiring 6.

The electron-emitting devices 1 are provided in n×m units, which are wired in a simple matrix with n X-direction wirings 5 and m Y-direction wirings 6. In the present example, there are adopted n=1024×3 and m=768.

The electron-emitting device 1 is not particularly restricted in a material, a shape or a producing method. The electron-emitting device 1 can be a cold cathode device such as a surface conduction electron-emitting device, an FE electron-emitting device or an MIM electron-emitting device.

An insulating layer (not shown) is provided in a crossing portion of the X-direction wiring 5 and the Y-direction wiring 6 to maintain an electrical insulation therebetween. The X-direction wiring 5 had a line width of 50 μm, while the Y-direction wiring 6 had a line width of 250 μm. The X-direction wiring 5 and the Y-direction wiring 6 were prepared by screen printing and drying an Ag photopaste ink, then executing an exposure in a predetermined pattern followed by a development and a baking at about 480° C. Also the insulating layer was formed by repeating three times a cycle of a screen printing of a photosensitive glass paste principally constituted of PbO, an exposure and a development, followed by a baking at about 480° C.

After the formation of the X-direction wirings 5, the Y-direction wirings 6, the insulation layers (not shown), device electrodes 22, 23 of the electron-emitting devices 1 and a conductive film 24 bridging each pair of the device electrodes 22, 23, an electroforming process (to be explained later) and an electroactivation process (to be explained later) were conducted by a current supply between each device electrodes 22, 23 through the X-direction wiring 5 and the Y-direction wiring 6, thereby producing a multi electron beam source in which the plural electron-emitting devices 1 are wired in a simple matrix. There are shown an electron emitting portion 25 formed by the electroforming process, and a carbon film formed by the electroactivation process.

(Preparation of Electron-Emitting Device)

In the following there will be explained a device structure and a producing method for a surface conduction electron-emitting device as an example of the electron-emitting device.

Figure 14A:
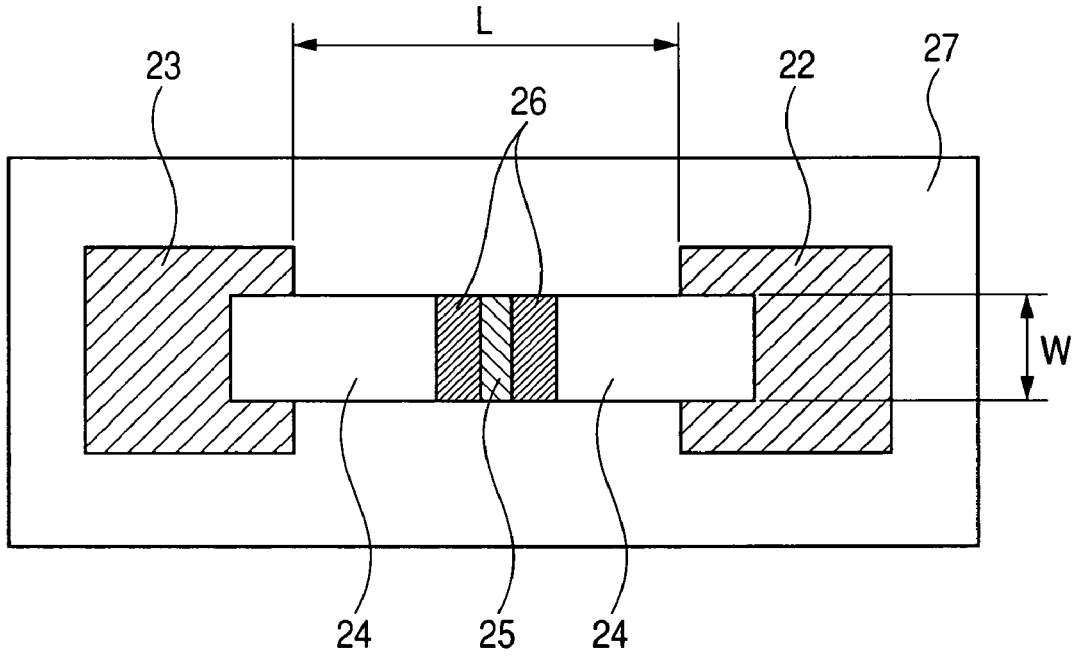
FIGS. 14A and 14B are respectively a plan view and a cross-sectional view, showing a surface conduction electron-emitting device prepared in an example 1.
Figure 14B:
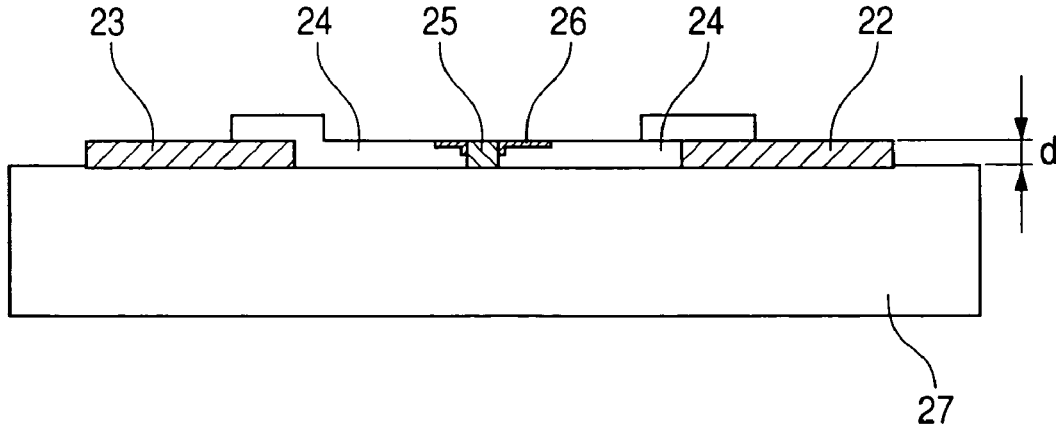

FIGS. 14A and 14B are respectively a plan view and a cross-sectional view showing a configuration of a surface conduction electron-emitting device, wherein shown are device electrodes 22, 23, a conductive thin film 24, an electron emitting portion 25 formed by the electroforming process, a film 26 formed by the electroactivation process, and a base plate 27 constituting a base of the rear plate 2.

The base plate 27 was constituted of PD-200 (manufactured by Asahi Glass Co.), and the device electrodes 22, 23 were constituted of Pt films. The device electrodes 22, 23 had a thickness d of 500 Å, and an electrode gap L of 10 μm.

The conductive film 24 was principally constituted of Pd or PdO, and had a film thickness of about 100 Å and a width W of 100 μm.

FIGS. 15A to 15D are views explaining production steps for the surface conduction electron-emitting device, wherein members are represented by symbols same as those in FIG. 14.

(1) At first, as shown in FIG. 15A, device electrodes 22, 23 were formed on the base plate 17. In this formation, a material of the device electrodes 22, 23 was deposited in advance by evaporation or sputtering onto the base plate 27. Then the deposited electrode material was patterned for example by a photolithographic etching technology to obtain a pair of device electrodes 22, 23 as shown in FIG. 15A.

(2) Then, as shown in FIG. 15B, a conductive thin film 24 was formed. In the formation, a metalorganic solution was coated for example by a dip coating method on the base plate 27, subjected to the process shown in FIG. 15A, and dried and baked to form a film of fine particles, which was then patterned into a predetermined shape by a photolithographic etching. The metalorganic solution was formed from a metalorganic compound containing, as a principal element, a material of fine particles for the conductive film 24, and, in the present example, Pd was employed as the principal element.

(3) After the formation of the conductive film 24, a suitable voltage was applied from a forming power source 28 between the device electrodes 22 and 23 as shown in FIG. 15C, thereby forming an electron emitting portion 25 in the conductive film 24. The electroforming process means a process of a current supply to the conductive film 24 formed by a film of fine particles, to cause a destruction, a deformation or a modification suitably in a part, thereby causing a change to a structure suitable for an electron emission. Within the conductive film 24 formed by the fine particle film, a suitable fissure is formed therein in a portion modified to a structure suitable for electron emission (namely in the electron emitting portion 25).

(4) Then, as shown in FIG. 15D, an activation power source 29 is used to apply an appropriate voltage between the device electrodes 22 and 23, to execute an electroactivation process thereby improving the electron-emitting characteristics. The electroactivation process means a process of a current supply under a suitable condition to the electron emitting portion 25 formed by the electroforming process, thereby depositing carbon or a carbon compound in the vicinity thereof. (In FIG. 15D, a deposit of carbon or a carbon compound is represented schematically as a carbon film 26.) More specifically, by periodical applications of voltage pulses in a vacuum atmosphere of $10^{-3}$ to $10^{-4}$ Pa, there is deposited carbon or a carbon compound originating from an organic compound present in such vacuum atmosphere.

The surface conduction electron-emitting device shown in FIG. 14 was prepared as described above.

Then, on the rear plate 2 explained in the foregoing "preparation of rear plate", a spacer 9 was positioned at the crossing portion of the X-direction wiring 5 and the Y-direction wiring 6 as shown in FIG. 1. The spacer 9 was a cylindrical column, formed by PD-200 same as the material for the base plate 27 constituting the base of the rear plate 2, and had a diameter of 100 μm and a length of 2.0 mm. The spacer 9 was adhered to the rear plate 2 utilizing frit glass as an adjoining member, and was fixed by heating for about 10 minutes at 400 to 500° C.

Also a frame member 4 was adhered with the frit glass to the rear plate 2 and was fixed by heating for about 10 minutes at 400 to 500° C. The spacer 9 was so set as to be slightly higher than the frame member 4, in order to function as a thickness defining member in a sealing operation with an In film to be explained later.

The adhesion of the spacer 9 and the frame member 4 was completed by the aforementioned steps.

(Preparation of Face Plate)

In the following, a face plate 3 will be explained.

A base plate 30 constituting a base of the face plate 3 was constituted of PD-200, and a phosphor film 7 was formed on a lower face (internal surface) thereof, as shown in FIG. 1. In the present example, in order to execute a color image display, phosphors of three primary colors of red, green and blue, utilized in the CRT technology, were coated in the part of the phosphor film 7. The coating was made in a stripe shape in which the phosphor of each color extends in the direction of column (Y-direction) as shown in FIG. 16, and a black conductive member 29, called a black matrix, was positioned between the phosphors of respective colors (R, G, B) and also between pixels in the Y-direction. The phosphor film 7 and the black conductive member 29 were adhered to the base plate 30 by respectively screen printing a phosphor paste and a black pigment paste and executing a baking for 4 hours at about 450° C.

Then a metal back 8 was provided as a reflective layer. The metal back 8 serves to mirror reflect a part of the light emitted by the phosphor 7 thereby improving an efficiency of light utilization, also to protective the phosphor film 7 from a collision of negative ions, and serves as an electrode for applying an electron beam accelerating voltage, and as a conductive path for the electrons that have excited the phosphor film 7. The metal back 8 was formed by smoothing the surface of the phosphor film 7, then vacuum evaporating Al thereon with a thickness of 500 nm and executing a baking.

The face plate 3 was prepared through the aforementioned steps.

The rear plate 2 and the face plate 3, prepared as described above, were respectively placed in a vacuum chamber evacuated to about $1\times10^{-5}$ Pa, and were baked for 5 hours at 300° C.

(SE Detection Step)

Then, in the vacuum chamber, there was conducted an SE detection step, which was executed with the apparatus shown in FIG. 3.

The anode electrode 10 was positioned on a plane opposed to the rear plate 2. A size of a face of the anode electrode 10 opposed to the rear plate 2 defines a resolution and a measuring time of the current distribution to be measured. In the present example, the face of the anode electrode 10 opposed to the rear plate 2 had a size of about 0.01 $mm^2$. In practice, there is preferred a size of 1 to 0.0001 $mm^2$. It is also possible to prepare plural anode electrodes 10 of different sizes, and to switch such electrodes.

The moving apparatus 11 utilized a moving mechanism employing a piezo drive and a stepping motor drive in combination, and had a resolution and a positional reproducibility of about 3 μm in the displacement along the plane of the rear plate 2. Also a distance to the rear plate 2 had a resolution and a positional reproducibility of about 5 μm and can be controlled within a range of about 0 to 10 mm.

The high voltage source 12 was a commercially available product and could apply a voltage up to 20 kV.

The ammeter 13 was constituted of a commercially available picoammeter having a current resolution of about 10 fA.

The ammeter 13 was connected to the wirings of the rear plate 2. In the rear plate, all the wirings were connected in common, so that all the currents flowing in the rear plate 2 could be measured.

The control apparatus 14 had a function of monitoring and controlling a coordinate value of the moving apparatus 11, a voltage of the high voltage source 12 and a current of the ammeter 13.

In the present example, a current distribution was measured by at first setting the high voltage source 12 at a voltage 10 kV, the distance D1 between the rear plate 2 and the anode electrode 10 at 2 mm and moving the anode electrode 10 by the moving apparatus 11 in a scanning motion along the plane of the rear plate 2. The rear plate 2 contained convex and concave portions for example by wirings, and the distance D1 indicates a distance from a highest portion among such convex and concave portions (excluding the spacers) to the anode electrode 10. The spacers 9 are provided on the rear plate 2, and the scanning operation is not conducted around such spacers in order that the anode electrode 10 does not touch the spacer 9.

Figure 17:
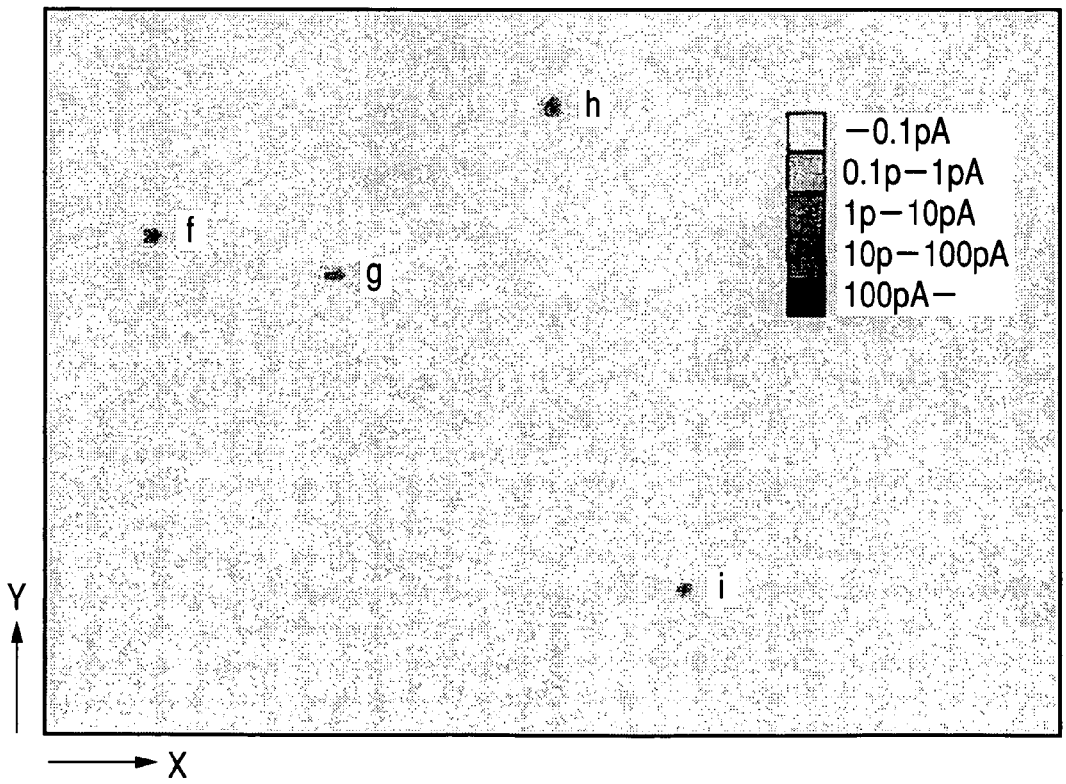
FIG. 17 is a view showing an SE current distribution in an example 1.

FIG. 17 is a current distribution chart (contour line chart) in the plane of the rear plate 2 obtained with the distance D1.

In FIG. 17, the SE current distribution appears in four positions f to i. All these indicate an emission current by SE.

Figure 18:
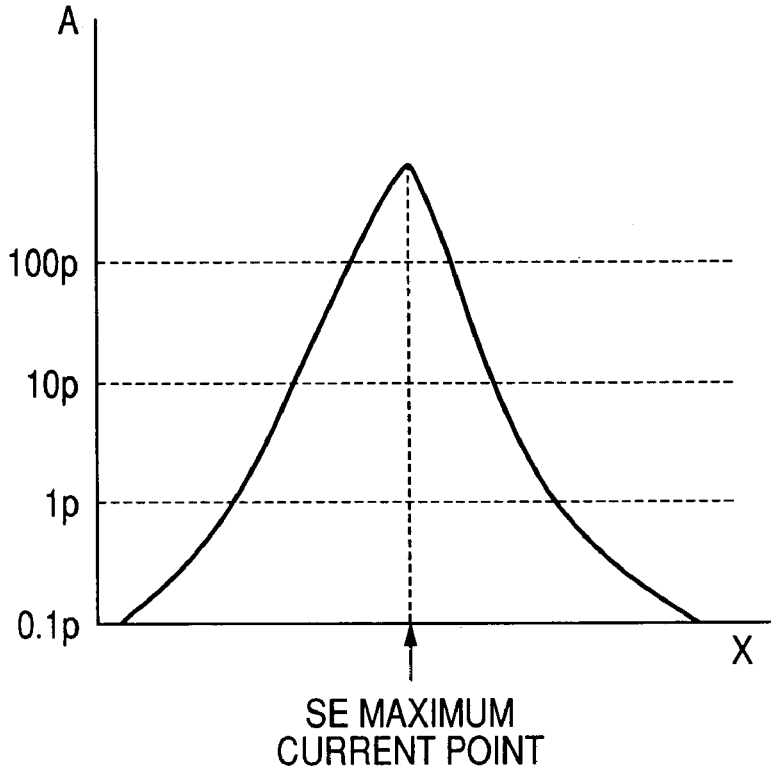
FIG. 18 is a cross-sectional view, along an X-direction, of an SE current distribution point f in FIG. 17.

FIG. 18 shows a cross-sectional current distribution along X-direction in a plane, including a maximum current point in the vicinity of the SE current distribution point f.

Then the current distribution was determined by changing the distance by the moving apparatus 11 from D1 to D2=0.5 mm, also setting the voltage at V2=2.5 kV and scanning the plane of the rear plate 2 again with the anode electrode 10. Similar operations were carried out for a distance D3=0.3 mm (applied voltage V3=1.5 kV) and a distance D4=0.1 mm (applied voltage V4=0.5 kV). The SE maximum current points could be determined also for D2 to D4, in the same manner as in the SE maximum current point for the distance D1.

Figure 19:
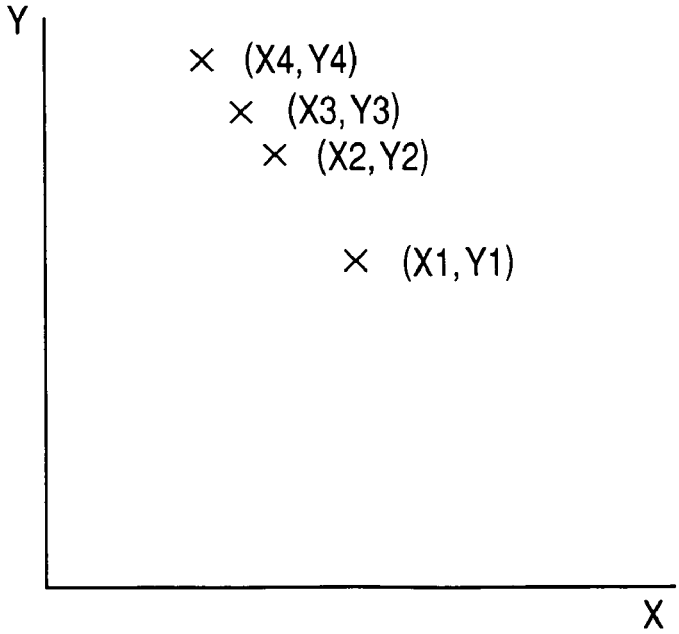
FIG. 19 is a view showing X-Y coordinate positions of the SE maximum current points in an example 1.

FIG. 19 shows a plotting of X, Y coordinates of the SE maximum current points at the SE current distribution point f. In FIG. 19, (X1, Y1), (X2, Y2), (X3, Y3), and (X4, Y4) indicate coordinates of the SE maximum current points of the SE current distribution point f at the distances D1 to D4. In this manner, the X, Y coordinates of the SE maximum current point move dependent on the distance D.

Figure 20:
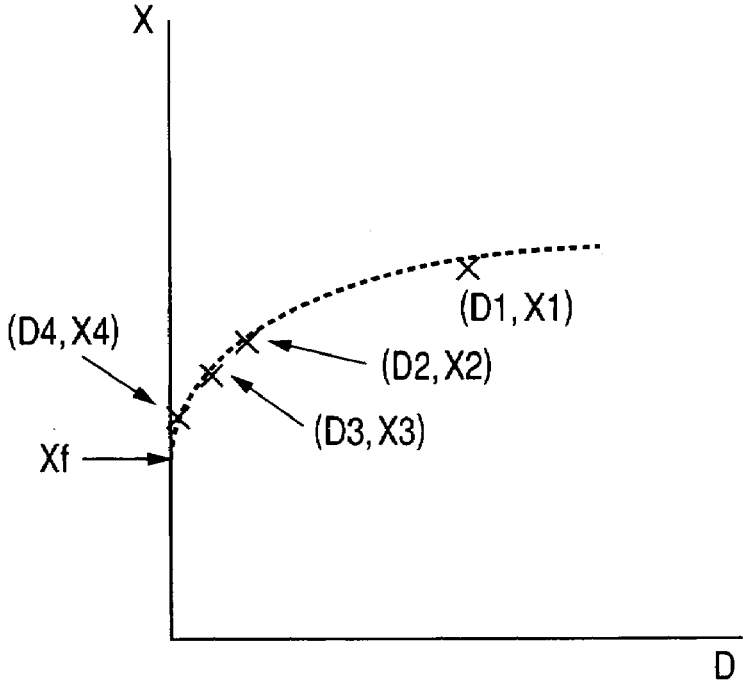
FIG. 20 is a chart showing a relationship between an X-coordinate of the SE maximum current point and a distance D in an example 1.

FIG. 20 shows a relation of the X coordinate components, obtained from FIG. 19, with the distances D. A line (parabolic line) connecting these points indicates electron trajectories of SE. This line can be extrapolated to a position D=0 to obtain an X-coordinate Xf of the SE source in the X-direction. The position of the SE source is derived in the same manner also in the Y-direction and the coordinate values of the position of the SE maximum current point can thus be determined.

Similar operations were conducted also on the SE maximum current points of the SE current distributions g to i. The process of deriving the SE generating position (position of SE source) was conducted in the control apparatus 14.

Another rear plate 2 subjected to a similar process was taken out from the vacuum chamber and was subjected to an observation of an SE generating position under a scanning electron microscope (SEM) for the purpose of confirmation. As a result, an extraneous substance, assumed as an emission source, was confirmed in the vicinity of each SE generation position. According to an investigation by the present inventors, a distance of the estimated SE generating position to the extraneous substance assumed as the emission source was 20 μm or less.

(SE Elimination Step)

Then an SE elimination step will be explained.

The present example employed the apparatus shown in FIG. 3 for the SE elimination step.

The anode electrode 10 was moved by the moving apparatus 11 to the detected position of the SE source, and the distance was set at Dr=0.2 mm. Then the voltage was gradually raised by the high voltage source 12.

Figure 21:
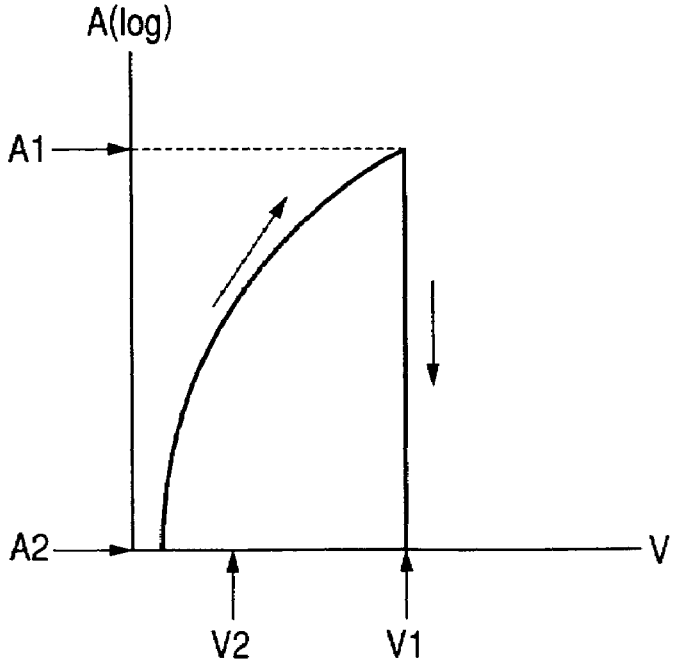
FIG. 21 is a chart showing a relationship between a voltage and a current obtained in the SE elimination step in an example 1.

FIG. 21 shows a relation of the voltage V of the high voltage source 12 and a current A (in logarithmic value) read on the ammeter 13. The SE current measured by the ammeter 13 increased with an increase of the voltage. However a discharge was generated at a certain voltage (V1≅2.3 kV) and the SE current was no longer observed. This means that the SE current was not observed at an electric field strength corresponding to an image display (V2=about 1 kV), so that the SE was eliminated. An elimination process was similarly conducted also for the SE generating positions b to d.

(Sealing and Display)

Then the rear plate 2 and the face plate 3 were sealed.

After an In film was coated on the frame member 4, the face plate 3 and the rear plate 2 were supported in a state of a constant distance therebetween, and the temperature was raised close to the melting point of In. The distance between the face plate 3 and the rear plate 2 was gradually reduced by a positioning apparatus to achieve an adjoining or a sealing of the two, thereby forming a display panel 20.

In order to maintain a vacuum level in the sealed display panel 20, a getter film (not shown) was formed in a predetermined position in the panel. The getter film was formed by evaporating a getter material principally constituted of Ba by a heating with a heater or by a high-frequency heating, and exerts an adsorbing function to maintain the interior of the display panel 20 at a vacuum level of $1\times10^{-4}$ to $1\times10^{-6}$ Pa.

In the present example, the steps of SE detection and SE elimination were conducted after the spacer 9 and the frame member 4 were fixed to the rear plate, but the fixation of the spacer 9 and the frame member 4 may be executed after these steps.

On thus prepared display panel 20, a driving circuit including a scanning circuit, a control circuit, a modulation circuit, a DC power source etc. was connected to obtain an image display apparatus as an electron beam apparatus of the present invention.

Referring to FIG. 1, a potential difference of 15 V was given to the electron-emitting devices 1 through the lead terminals Dx1 to Dxn and Dy1 to Dym, whereby electrons were emitted from the respective electron-emitting devices 1. At the same time, a high voltage of 10 kV was applied to the metal back 8 through the high voltage terminal Hv, whereby the emitted electrons were accelerated and collided with the internal surface of the face plate 3 to excite the phosphors of respective colors constituting the phosphor film 7, thereby causing a light emission and displaying an image. It is preferred that the voltage applied to the surface conduction electron-emitting device constituting the electron-emitting device 1 is about 10 to 20 V, the distance between the metal back 8 and the electron-emitting device 1 is about 0.1 to 8 mm and the voltage between the metal back 8 and the electron-emitting device 1 is about 1 to 20 kV.

In the image display, the image display apparatus (electron beam apparatus) was confirmed to have excellent display characteristics, without any unnecessary bright point by SE nor a damage by discharge.

A sufficiently small anode electrode 10 (or a capacity thereof) as in the present example provides an effect of suppressing a charge amount at the discharge restricting the damage of discharge to the SE generating position only. In comparison with an anode capacity of several nanofarads in a display panel 20 corresponding to 40 inches, the anode electrode of the present example is suppressed to several to several tens of picofarads.

As a variation to the present example, a current limiting resistance (1 KΩ to 1 GΩ) may be inserted between the high voltage source 12 and the anode electrode 10 to further suppress the damage of discharge. Also the elimination step may be executed similarly, utilizing a negative voltage from the high voltage source 12. In such case, the SE generation source becomes an anode and the SE elimination can be promoted by a damage by an impact with the electron beam.

Example 2

The present example executes an SE detection step after the display panel 20 is assembled by sealing, and executes an SE elimination step by a laser heating.

(Outline of Display Panel, and Preparation of Rear Plate and Face Plate)

In the present example, the outline of the display panel 20 and the preparation of the rear plate 2 and the face plate 3 are same as those in Example 1 and will not, therefore, be explained further.

(Sealing)

The sealing of the rear plate 2 and the face plate 3 was executed by coating an In film on the frame member 4, then supporting the face plate 3 and the rear plate 2 in a state of a constant distance therebetween, raising the temperature close to the melting point of In and gradually reducing the distance between the face plate 3 and the rear plate 2 by a positioning apparatus to a mutual contact. The distance of the face plate 3 and the rear plate 2 was selected as 2.0 mm.

(SE Detection Step)

The SE detection was conducted with the apparatus shown in FIG. 10.

The photo detector 19 was constituted of a commercially available cooled CCD (16-bit range). The moving apparatus 11 had a structure same as that in Example 1, and was used for controlling the position of the photo detector 19. The control apparatus 14 had a function of monitoring and controlling a coordinate value of the moving apparatus 11, a voltage of the high voltage source 12 and a light intensity output of the photo detector 19.

In the present example, a light intensity distribution in the plane of the rear plate 2 was measured by setting the high voltage source 12 at a voltage V1 of 15 kV, and moving the photo detector 19 by the moving apparatus 11 in a scanning motion along the plane.

Figure 22:
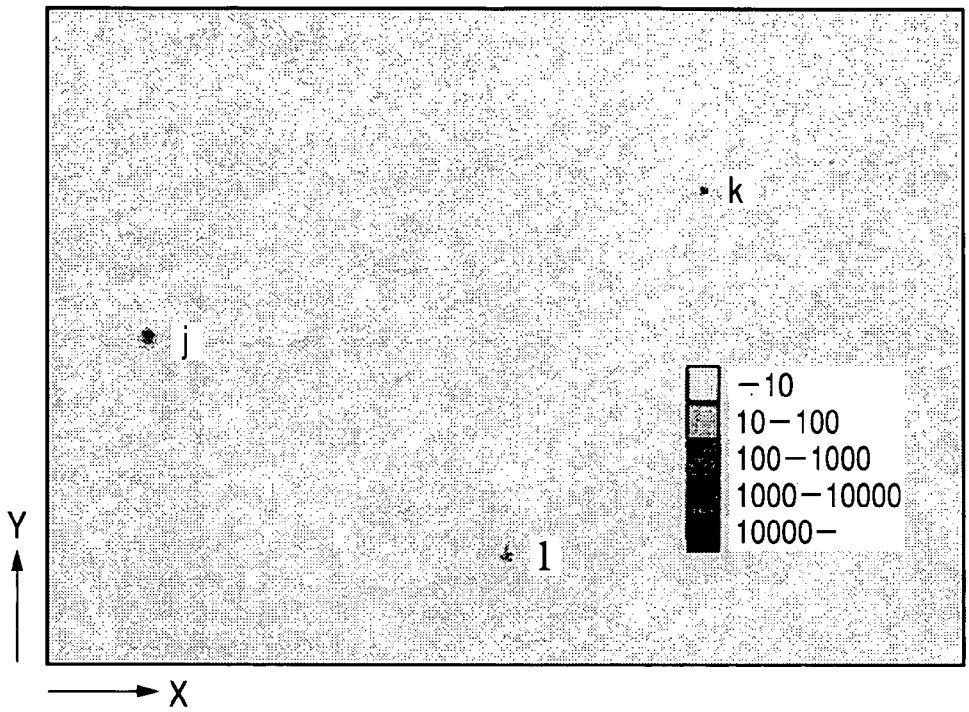
FIG. 22 is a view showing a light intensity distribution in an example 2.

FIG. 22 shows an SE light intensity distribution (contour line chart, height indicating a number of level). In FIG. 22, the light intensity became locally high (SE light intensity distribution) in three locations j to l. In each SE light intensity distribution, an SE maximum light emission point was selected as a point with a maximum light intensity, and coordinate values of such point were determined.

Then similar measurements were conducted by setting the high voltage source at V2=10 kV and V3=5 kV.

Figure 23:
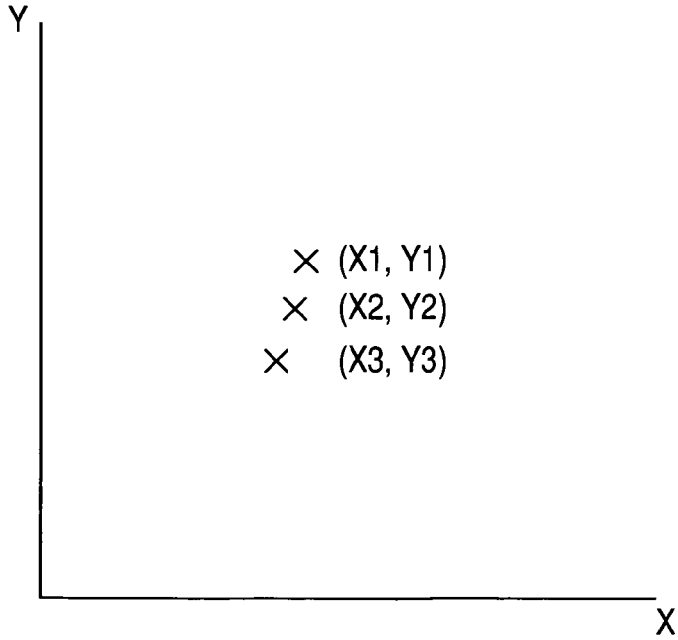
FIG. 23 is a view showing X-Y coordinate positions of the SE maximum current points in an example 2.

FIG. 23 shows a result of plotting of the X, Y coordinates of the SE maximum light emission points at voltages V1 to V3, in an SE light intensity distribution point j.

Figure 24:
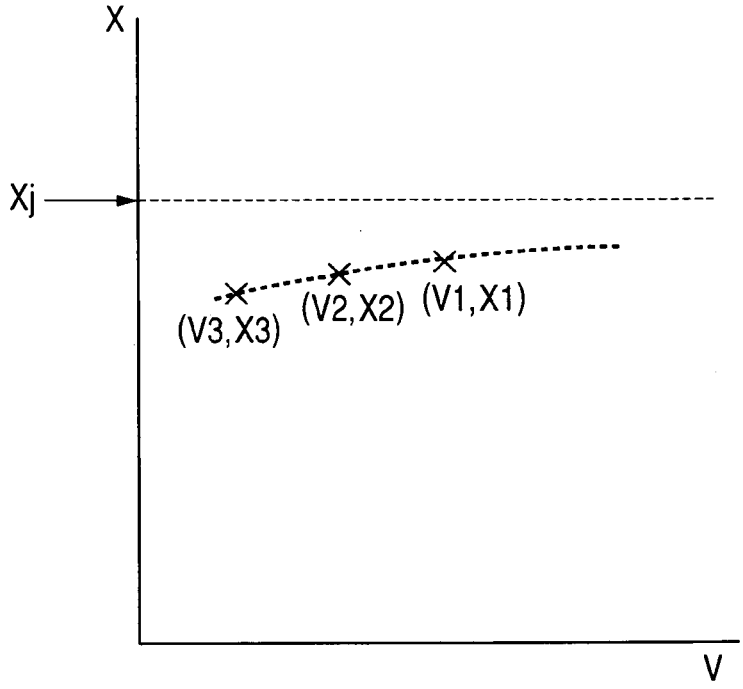
FIG. 24 is a chart showing a relationship between an X-coordinate of the SE maximum light-emitting point and a voltage V in an example 2.

FIG. 24 shows a relation of the X coordinate components, obtained from FIG. 23, with the applied voltages V. This line (parabolic line) can be extrapolated to a position V=∞ to obtain an X-coordinate Xj of the SE source in the X-direction. The position of the SE source is derived in the same manner also in the Y-direction as the Y-coordinate position of the SE source in the SE light intensity distribution, and X and Y coordinate values were thus determined. Similar operations were conducted also on the SE maximum light emission points of the SE light intensity distributions k, l. The process of deriving the position of the SE source was conducted in the control apparatus 14.

Another display panel 20 subjected to a similar process was disassembled and was subjected to an observation of an SE source position on the rear plate 2 under a scanning electron microscope (SEM) for the purpose of confirmation. As a result, an extraneous substance, assumed as an emission source, was confirmed in the vicinity of each estimated SE generation position. According to an investigation by the present inventors, a distance of the estimated SE generating position to the extraneous substance assumed as the emission source was 50 μm or less.

(SE Elimination Step)

Then an SE elimination step will be explained.

The SE elimination step was conducted with an apparatus shown in FIG. 12.

In FIG. 12, there are shown a laser oscillator 21, a moving apparatus 11, a high voltage source 12, a display panel 20 and a control apparatus 14.

The display panel 20 was so positioned that the rear plate 2 was opposed to the laser oscillator 21, which was constituted of a $CO_2$ laser. The $CO_2$ laser was capable of continuous oscillation or pulsed oscillation, and was condensed by an optical system to a diameter of about 70 μm. The control apparatus 14 had a function of monitoring and controlling an output of the laser oscillator 21, a coordinate value of the moving apparatus 11, and a voltage of the high voltage source 12.

At first a voltage of the high voltage source 12 was set at 7 kV.

Then the laser oscillator 21 was moved to the detected position of the SE source by the moving apparatus 11, and a laser irradiation was conducted in such position to execute a local heating. As a temperature rising rate is variable depending on a material and a thickness of the SE source portion subjected to the laser irradiation, the setting of the laser output has be regulated cautiously. An output-temperature table is prepared in advance for each member of the rear plate, and an output at which the member does not reach the melting temperature is selected as a maximum value. Then the laser output was increased gradually, whereby the light emission by SE became unstable and a discharge was eventually generated. A similar process was conducted on the SE sources in two other locations.

The present example employed a $CO_2$ laser as a heating laser, but various lasers such as a YAG laser or an UV laser can be used in the present invention.

(Display)

On thus prepared display panel 20, a driving circuit including a scanning circuit, a control circuit, a modulation circuit, a DC power source etc. was connected to obtain an electron beam apparatus of the present invention.

As in Example 1, a potential difference of 15 V was given to the lead terminals Dx1 to Dxn and Dy1 to Dym, and a high voltage of 10 kV was given to the high voltage terminal Hv, whereby an image was displayed. The electron beam apparatus was confirmed to have excellent display characteristics, without any unnecessary bright point by SE as in the prior apparatus, nor a damage by discharge.

Example 3

The present example executes an SE detection step before the sealing, and executes an SE elimination step by a degradation caused by a continued emission.

(Outline of Display Panel, Preparation of Rear Plate and Face Plate, and SE Detection Step)

In the present example, the outline of the display panel 20, the preparation of the rear plate 2 and the face plate 3 and the SE detection are same as those in Example 1 and will not, therefore, be explained further.

(SE Elimination Step)

Then an SE elimination step will be explained.

The present example employed the apparatus shown in FIG. 3 for the SE elimination step.

The anode electrode 10 was moved by the moving apparatus 11 to the detected position of the SE source, and the distance was set at Dr=0.2 mm. Then the voltage Vr of the high voltage source 12 was set according to a current of the ammeter 13. Vr is preferably a largest possible voltage lower than a discharge voltage of SE. Since the discharge threshold current of SE is generally 5 to 50 μA, there is selected a voltage Vr providing a current of 1 to 3 μA. Also as the SE current shows instability immediately before the discharge, the voltage Vr may be determined based on such phenomenon. In the present example, there was obtained Vr=1.5 kV, providing an electric field slightly larger than that required for image display.

(Sealing and Display)

The sealing, mounting of peripheral devices and display method are similar to those in Example 1 and will not, therefore, be explained further.

As a result of image display, there was obtained an electron beam apparatus having excellent display characteristics, without any unnecessary bright point by SE.

In the present example, as explained in the foregoing, a predetermined voltage is applied continuously to promote degradation of the emission thereby eliminating the SE source, and such method is particularly effective in case, for example, an SE source is present in the vicinity of a prepared electron-emitting device 1 and a discharge may damage the electron-emitting device 1. However this method is time-consuming as the degradation of emission requires several to about twenty hours.

Example 4

The present example executes an SE detection step before the sealing, and executes an SE elimination step by employing a heating in combination.

(Outline of Display Panel, Preparation of Rear Plate and Face Plate, and SE Detection Step)

In the present example, the outline of the display panel 20, the preparation of the rear plate 2 and the face plate 3 and the SE detection are same as those in Example 1 and will not, therefore, be explained further.

(SE Elimination Step)

Then an SE elimination step will be explained.

The SE elimination of the present example is different from that of Example 1 in executing the elimination under heating the position of the SE source.

The SE elimination step of the present example will be explained with reference to FIG. 25.

Figure 25:
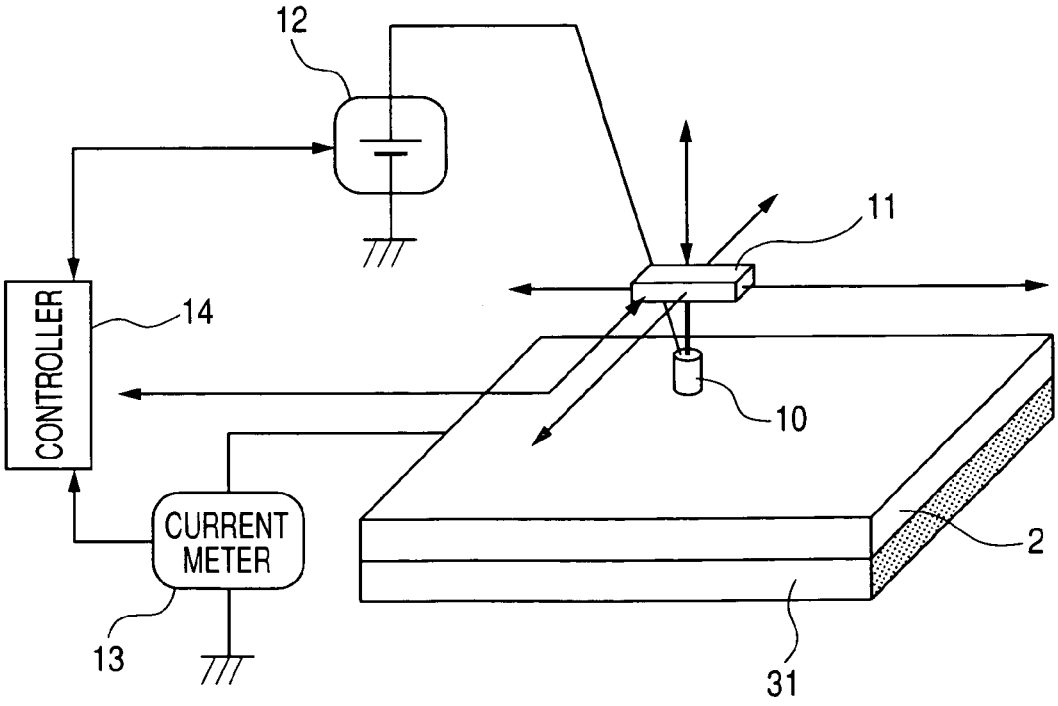
FIG. 25 is a schematic view of an apparatus employed in the SE elimination step in an example 4.

In FIG. 25, there are shown an anode electrode 10, a moving apparatus 11, a high voltage source 12, an ammeter 13, a control apparatus 14, a rear plate 2, and a heater 31.

As shown in FIG. 25, the apparatus is same as that shown in FIG. 3, but a heater 31 is used in combination. The heater 31 is a planar heater (hot plate) incorporating a sheath heater, and is contacted with the rear plate 2 for heating the same.

After the rear plate 2 was heated to about 400° C. by the heater 31, the anode electrode 10 was moved by the moving apparatus 11 to the detected position of the SE source, and the distance was set at Dr=0.2 mm. Then the voltage was gradually raised by the high voltage source 12. A discharge was generated at a certain voltage (2.0 kV in the present example) and the SE current was no longer observed by the ammeter 13. An elimination process was similarly conducted for all the SE sources.

(Sealing and Display)

The sealing, mounting of peripheral devices and display method are similar to those in Example 1 and will not, therefore, be explained further. As a result of image display, there was obtained an electron beam apparatus having excellent display characteristics, without any unnecessary bright point by SE.

In the present example, as explained in the foregoing, the SE source is subjected to a heating in addition to a voltage application to cause a discharge at a lower voltage, whereby the damage by discharge is made smaller than in Example 1. However it is required to add a time for heating the rear plate 2 and to provide the rear plate 2 with heat resistance.

Example 5

The present example executes an SE detection step before the sealing, and executes an SE elimination step by employing a gas introduction in combination.

(Outline of Display Panel, Preparation of Rear Plate and Face Plate, and SE Detection Step)

In the present example, the outline of the display panel 20, the preparation of the rear plate 2 and the face plate 3 and the SE detection are same as those in Example 1 and will not, therefore, be explained further.

(SE Elimination Step)

Then an SE elimination step will be explained.

The present example is different from Example 1 in executing the SE elimination under a gas introduction.

The SE elimination step of the present example will be explained with reference to FIG. 26.

Figure 26:
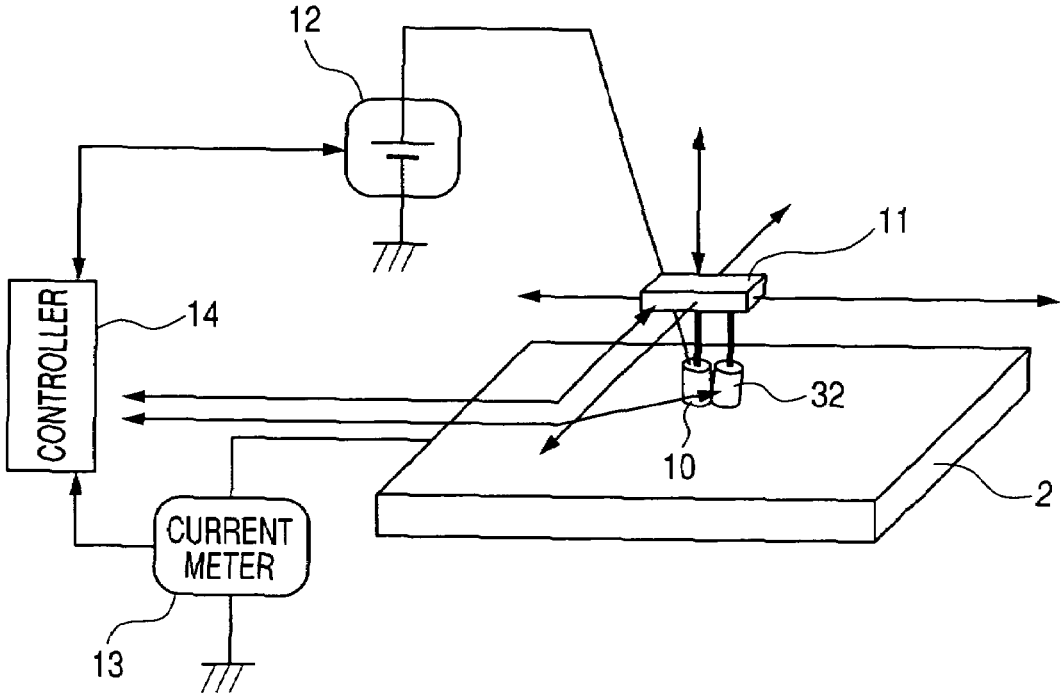
FIG. 26 is a schematic view of an apparatus employed in the SE elimination step in an example 5.

In FIG. 26, there are shown an anode electrode 10, a moving apparatus 11, a high voltage source 12, an ammeter 13, a control apparatus 14, and a gas emission aperture 32.

As shown in FIG. 26, the apparatus is similar to that shown in FIG. 3, but it is provided with a gas emission aperture 32 in the vicinity of the anode electrode 10. The gas emission aperture 32 has a function of introducing a gas, introduced from a gas introducing pipe (not shown), under a predetermined pressure into the vicinity of the anode electrode 10. The control apparatus 14 has, in addition to the functions explained in the apparatus shown in FIG. 3, functions of controlling a pressure and a position of the gas introduced from the gas emission aperture 32. The moving apparatus 11 has, in addition to the functions explained in the apparatus shown in FIG. 3, a function of moving the position of the gas emission aperture 32 together with the anode electrode 10.

The anode electrode 10 and the gas emission aperture 32 were moved by the moving apparatus 11 to the detected position 5 of the SE source, and the distance D between the anode electrode 10 and the rear plate 2 (cf. FIG. 3) was set at 0.5 mm.

Then a gas was introduced from the gas emission aperture 32 under a predetermined pressure. For such gas, there can be utilized various gases capable of reducing an emission function or a discharge threshold of the SE source, such as $N_2$, $O_2$, $CO_2$, $H_2$ or Ar. An inert gas such as Ar gas can give a damage to the SE source thereby causing a degradation, by a sputtering effect. Also $O_2$ or $CO_2$ can suppress the emission by forming an oxide layer. $N_2$ or $H_2$ provides an effect of reducing the discharge threshold and suppressing the damage by discharge. $N_2$ was employed in the present example. The gas pressure was regulated at about 0.1 Pa in the vicinity of the anode electrode 10.

When the voltage was gradually raised by the high voltage source 12, a discharge was generated at about 0.5 kV and the SE current was no longer observed by the ammeter 13. An elimination process was similarly conducted for all the SE sources.

(Sealing and Display)

The sealing, mounting of peripheral devices and display method are similar to those in Example 1 and will not, therefore, be explained further. As a result of image display, there was obtained an electron beam apparatus having excellent display characteristics, without any unnecessary bright point by SE.

In the present example, as explained in the foregoing, there was conducted a gas introduction to the vicinity of the SE source in addition to a voltage application to cause a discharge at a lower voltage, whereby the damage by discharge is made smaller than in Example 1. However it is required to add a step of discharging the introduced gas and to add a gas introduction system to the apparatus for SE source elimination.

Example 6

The present example executes an SE detection step before the sealing, and executes an SE elimination step physically.

(Outline of Display Panel, Preparation of Rear Plate and Face Plate, and SE Detection Step)

In the present example, the outline of the display panel 20, the preparation of the rear plate 2 and the face plate 3 and the SE detection are same as those in Example 1 and will not, therefore, be explained further.

(SE Elimination Step)

Then an SE elimination step will be explained.

The present example is different from Example 1 in executing the SE elimination by locally heating the SE source thereby deforming and eliminating the SE source.

Figure 27:
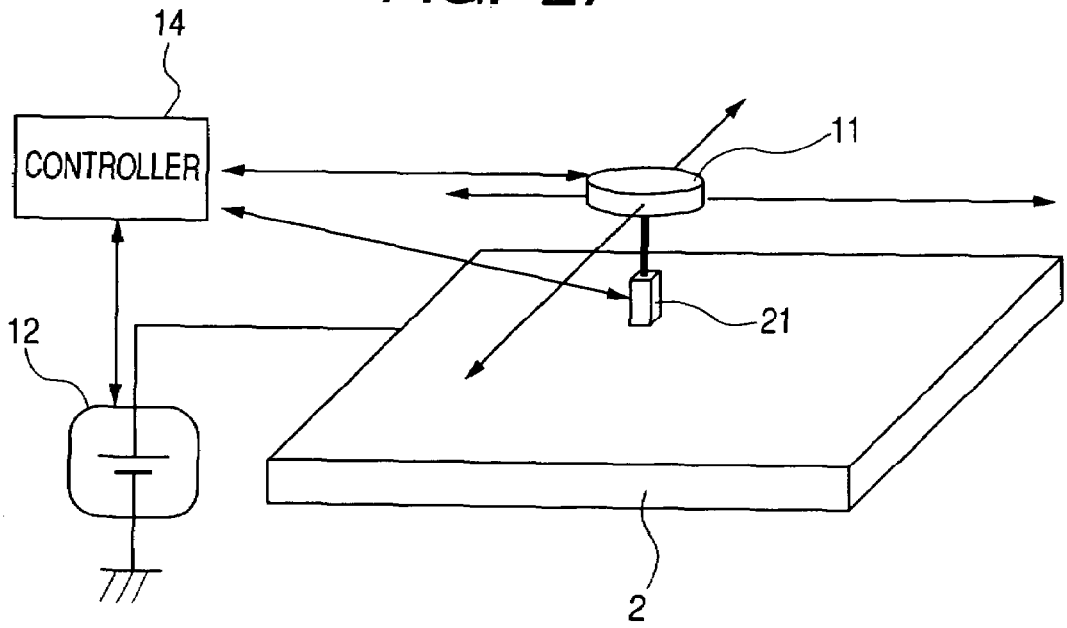
FIG. 27 is a schematic view of an apparatus employed in the SE elimination step in an example 6.

The SE elimination step of the present example can be executed with an apparatus shown in FIG. 27.

A laser oscillator 21 is formed by a UV laser (YAG 4th harmonic wave, wavelength 266 nm), focused by an optical system to a diameter of about 15 μm, and, by an irradiation to a predetermined location, can heat a member in such location thereby causing a deformation or an evaporation. The moving apparatus 11 has a function of moving the position of the laser oscillator 21.

The laser oscillator 21 is moved by the moving apparatus 11 to the detected position of the SE source.

Then the laser beam from the laser oscillator 21 irradiates the position of the SE source. As a level of deformation of the member by a laser output is variable depending on a material and a thickness of the portion of the SE source, the laser output has to be cautiously regulated. An output-temperature table is prepared in advance for each member of the rear plate 2, and an output at which the member does not reach the melting temperature is selected. A similar process was conducted on all the SE sources.

(Sealing and Display)

The sealing, mounting of peripheral devices and display method are similar to those in Example 1 and will not, therefore, be explained further. As a result of image display, there was obtained an electron beam apparatus having excellent display characteristics, without any unnecessary bright point by SE.

In the present example, as explained in the foregoing, The SE source can be locally heated and deformed by a laser irradiation, the SE source can be eliminated without causing a damage by discharge. On the other hand, in case the SE source has a melting point much higher than that of the members of the rear plate 2 (for example a tungsten member is present as an SE source on Ag wiring), it is necessary to suitably modify the eliminating method, such as deforming the rear plate 2 thereby indirectly deforming the SE source.

This application claims priority from Japanese Patent Application No. 2004-274578 filed on Sep. 22, 2004, which is hereby incorporated by reference herein.

What is claimed is:

1. A producing method for an electron beam apparatus comprising a stray emission (SE) detection step of detecting a position of a stray emission (SE) source on a cathode substrate, and an SE elimination step of locally applying an energy for eliminating the SE in the position of the SE source detected by said SE detection step, wherein the SE detection step executes an operation of applying a voltage to an anode electrode opposed to the cathode electrode and measuring a signal generated by an SE under a scanning motion of the anode electrode thereby obtaining a peak position of the signal, with a change in a distance between the cathode substrate and the anode electrode, and derives a peak position corresponding to a situation where the distance is 0 based on a relationship between each distance and a corresponding peak position thereby detecting the position of the SE source.

2. A producing method for an electron beam apparatus according to claim 1, wherein, in changing the distance between the cathode substrate and the anode electrode, the voltage applied to the anode electrode is so applied as to provide a constant electric field strength.

3. A producing method for an electron beam apparatus comprising a stray emission (SE) detection step of detecting a position of a stray emission (SE) source on a cathode substrate, and an SE elimination step of locally applying an energy for eliminating the SE in the position of the SE source detected by said SE detection step, wherein the SE detection step executes an operation of applying a voltage to an anode electrode opposed to the cathode electrode and measuring a signal generated by an SE under a scanning motion of the anode electrode thereby obtaining a peak position of the signal, with a change in the applied voltage, and derives a peak position corresponding to a situation where the applied voltage is infinitely large based on a relationship between each applied voltage and a corresponding peak position thereby detecting the position of the SE source.

4. A producing method for an electron beam apparatus according to claim 1 or 3, wherein the signal is a current or a light intensity.

5. A producing method for an electron beam apparatus according to claim 1 or 3, wherein the anode electrode is formed by an auxiliary electrode for applying a predetermined voltage, and a signal detection portion for detecting the signal.

6. A producing method for an electron beam apparatus according to claim 1 or 3, wherein the SE elimination step is executed by locally heating the detected position of the SE source.

7. A producing method for an electron beam apparatus according to claim 6, wherein the local heating is executed by a laser irradiation.

8. A producing method for an electron beam apparatus comprising a stray emission (SE) detection step of detecting a position of a stray emission (SE) source on a cathode substrate, and an SE elimination step of locally applying an energy for eliminating the SE in the position of the SE source detected by said SE detection step, wherein the SE elimination step is executed by locally applying a voltage to the detected position of the SE source, and wherein the locally applied voltage is so selected that a stray emission current becomes 1 to 3 μA.

9. A producing method for an electron beam apparatus according to claim 8, wherein the locally applied voltage has such polarity that the SE source side is positive.

10. A producing method for an electron beam apparatus according to claim 8, wherein the cathode substrate is heated in combination with the local voltage application.

11. A producing method for an electron beam apparatus according to claim 8, wherein a gas is introduced to the detected position of the SE source in combination with the local voltage application.

12. A producing method for an electron beam apparatus comprising a stray emission (SE) detection step of detecting a position of a stray emission (SE) source on a cathode substrate, and an SE elimination step of locally applying an energy for eliminating the SE in the position of the SE source detected by said SE detection step, wherein the SE detection step executes, after a cathode substrate and an anode substrate are combined, an operation of applying a voltage to the anode substrate with a photo detector opposed to the anode electrode and measuring a signal generated by an SE under a scanning motion of the photo detector thereby obtaining a peak position of the light intensity, with a change in the voltage applied to the anode substrate, and derives a peak position corresponding to a situation where the voltage is infinitely large based on a relationship between each voltage and a corresponding peak position thereby detecting the position of the SE source.

13. A producing method for an electron beam apparatus according to claim 12, wherein the SE elimination step is executed by locally heating the detected position of the SE source.

14. A producing method for an electron beam apparatus according to claim 13, wherein the local heating is executed by a laser irradiation.

* * * * *